US011965436B2

(12) United States Patent
Ozeki

(10) Patent No.: US 11,965,436 B2
(45) Date of Patent: Apr. 23, 2024

(54) VARIABLE VALVE APPARATUS

(71) Applicant: SUZUKI MOTOR CORPORATION, Hamamatsu (JP)

(72) Inventor: Hisashi Ozeki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 91 days.

(21) Appl. No.: 17/846,669

(22) Filed: Jun. 22, 2022

(65) Prior Publication Data

US 2022/0412233 A1 Dec. 29, 2022

(30) Foreign Application Priority Data

Jun. 29, 2021 (JP) ..... 2021-107873

(51) Int. Cl.
*F01L 1/26* (2006.01)
*F01L 1/18* (2006.01)

(52) U.S. Cl.
CPC ..... *F01L 1/267* (2013.01); *F01L 1/18* (2013.01); *F01L 2305/00* (2020.05)

(58) Field of Classification Search
CPC ..... F01L 1/267; F01L 1/18; F01L 1/08; F01L 1/181; F01L 3/10; F01L 2305/00; F01L 2800/11; F01L 2820/045
USPC ..... 123/90.39
See application file for complete search history.

(56) References Cited

U.S. PATENT DOCUMENTS

2011/0132327 A1* 6/2011 Aso ..... F02D 13/0215 123/436
2013/0306013 A1* 11/2013 Zurface ..... F01L 13/0036 123/90.16

FOREIGN PATENT DOCUMENTS

JP 5907552 B2 4/2016

* cited by examiner

*Primary Examiner* — Kenneth J Hansen
*Assistant Examiner* — Kelsey L Stanek
(74) *Attorney, Agent, or Firm* — Stein IP, LLC

(57) ABSTRACT

There is provided a variable valve apparatus including: a plurality of rocker arms; a coupling pin disposed in a housing hole of the rocker arm closer to one side; a release pin disposed in a housing hole of the rocker arm closer to the other side; a pressing member; a transmission member; and a push-back member disposed so as to push back the transmission member from the other side. The pressing member is configured to push the coupling pin into the housing hole of the rocker arm closer to the other side to couple the plurality of rocker arms. The transmission member is configured to push back the coupling pin into the housing hole of the rocker arm closer to the one side to release a coupling of the plurality of rocker arms.

9 Claims, 9 Drawing Sheets

VARIABLE VALVE APPARATUS

CROSS-REFERENCE TO RELATED APPLICATIONS

This application is based on Japanese Patent Application No. 2021-107873 filed on Jun. 29, 2021, the contents of which are incorporated herein by way of reference.

TECHNICAL FIELD

The present invention relates to a variable valve apparatus.

BACKGROUND

In the related art, as a variable valve apparatus, a variable valve apparatus in which a plurality of rocker arms are coupled to switch a valve operation is known (for example, see Patent Literature 1). In a variable valve apparatus described in Patent Literature 1, a pair of rocker arms are arranged adjacent to each other, and a coupling pin is inserted into a housing hole of one rocker arm. When a part of the coupling pin enters a housing hole of the other rocker arm, the pair of rocker arms are coupled to each other and a pair of valves are simultaneously operated. When a part of the coupling pin comes out of the housing hole of the other rocker arm, a coupled state of the pair of rocker arms is released, and only the valve on one side is operated.

Patent Literature 1: Japanese Patent No. 5907552

A repulsive spring for pushing back the coupling pin is disposed in the housing hole of the other rocker arm described in Patent Literature 1. However, depending on a type of an engine or the like, there is a case where the repulsive spring cannot be disposed in the rocker arm, and even in such a case, there is a demand for a configuration in which the coupled state and a released state of the plurality of rocker arms can be simply switched.

The present invention has been made in view of the above, and an object thereof is to provide a variable valve apparatus that can switch a state between a coupled state and a released state of a plurality of rocker arms with a simple configuration even when a repulsive spring is not disposed in the rocker arm.

SUMMARY

There is provided a variable valve apparatus configured to change a valve operation in a cylinder head. The variable valve apparatus includes: a rocker shaft configured to extend from one side to the other side inside the cylinder head; a plurality of rocker arms configured to swing around an axis of the rocker shaft; a coupling pin disposed in a housing hole of the rocker arm closer to one side in an axial direction; a release pin disposed in a housing hole of the rocker arm closer to the other side in the axial direction; a pressing member disposed on one side of the rocker arm closer to the one side; a transmission member disposed on the other side of the rocker arm closer to the other side; and a push-back member disposed so as to push back the transmission member from the other side. The pressing member is configured to push the coupling pin into the housing hole of the rocker arm closer to the other side while pushing the release pin out toward the other side to couple the plurality of rocker arms. The transmission member is configured to be pushed back by the push-back member and to push back the coupling pin into the housing hole of the rocker arm closer to the one side via the release pin to release a coupling of the plurality of rocker arms.

DESCRIPTION OF EMBODIMENTS

In a variable valve apparatus according to one aspect of the present invention, a valve operation is changed in a cylinder head. A rocker shaft extends from one side to the other side inside the cylinder head, and a plurality of rocker arms are supported by the rocker shaft so as to be swingable around an axis. A coupling pin is disposed in a housing hole of the rocker arm closer to one side in an axial direction, and a release pin is disposed in a housing hole of the rocker arm closer to the other side in the axial direction. A pressing member is disposed on one side of the rocker arm closer to the one side, and a transmission member is disposed on the other side of the rocker arm closer to the other side. Further, a push-back member is disposed so as to push back the transmission member from the other side. The coupling pin is pushed into the housing hole of the rocker arm closer to the other side by the pressing member while the release pin is pushed out toward the other side. The coupling pin partially enters the housing hole of the rocker arm closer to the other side from the housing hole of the rocker arm closer to the one side, and the plurality of rocker arms are coupled via the coupling pin. The transmission member is pushed back by the push-back member, and the coupling pin is pushed back into the housing hole of the rocker arm closer to the one side via the release pin, so that the coupling of the plurality of rocker arms is released. In this way, even when the repulsive spring is not disposed in the rocker arm, the coupled state and the released state of the plurality of rocker arms can be switched by a simple configuration.

EMBODIMENTS

First Embodiment

Figure 1:
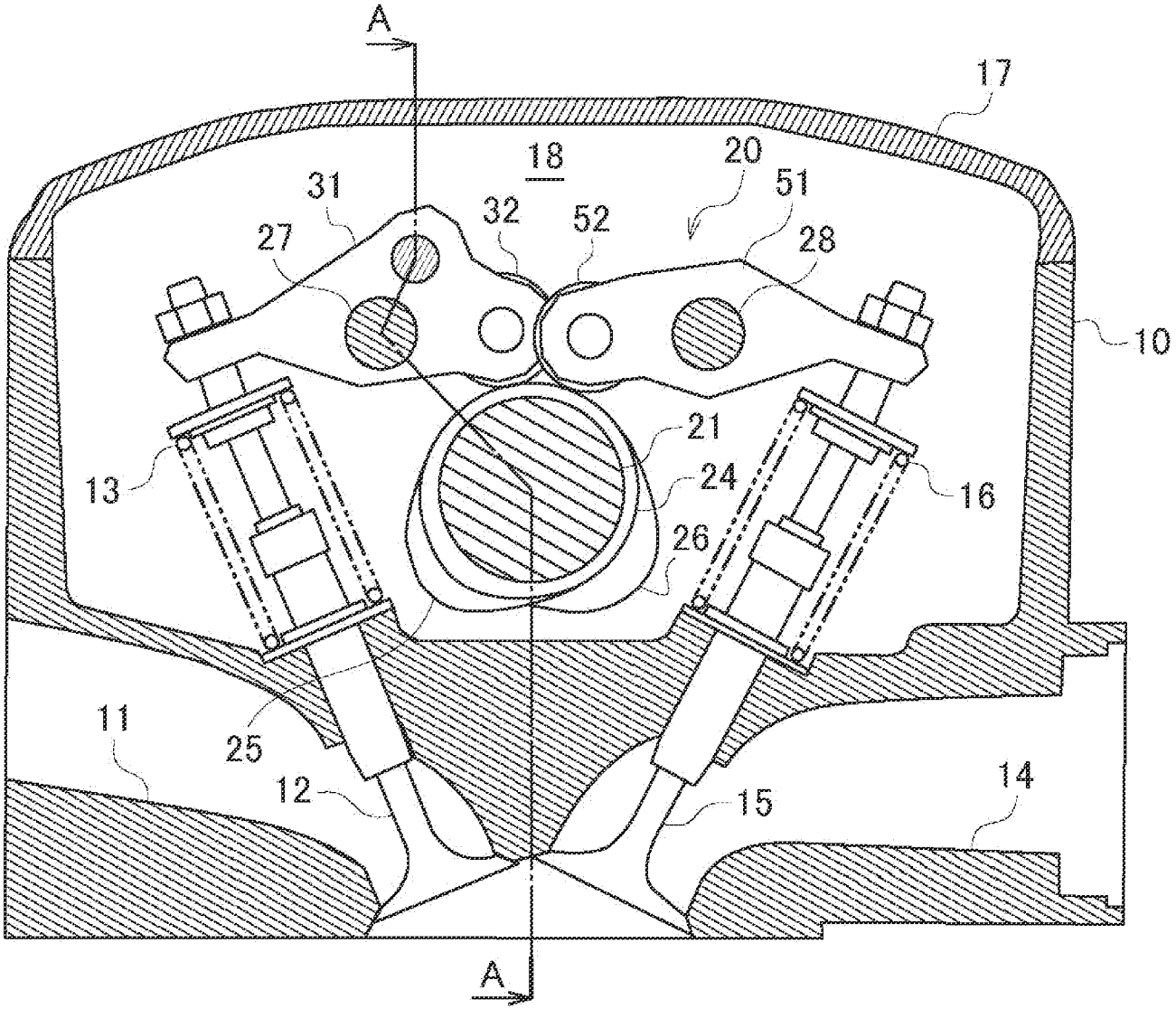
FIG. 1 is a schematic cross-sectional view of a cylinder head and a head cover according to a first embodiment.
Figure 2:
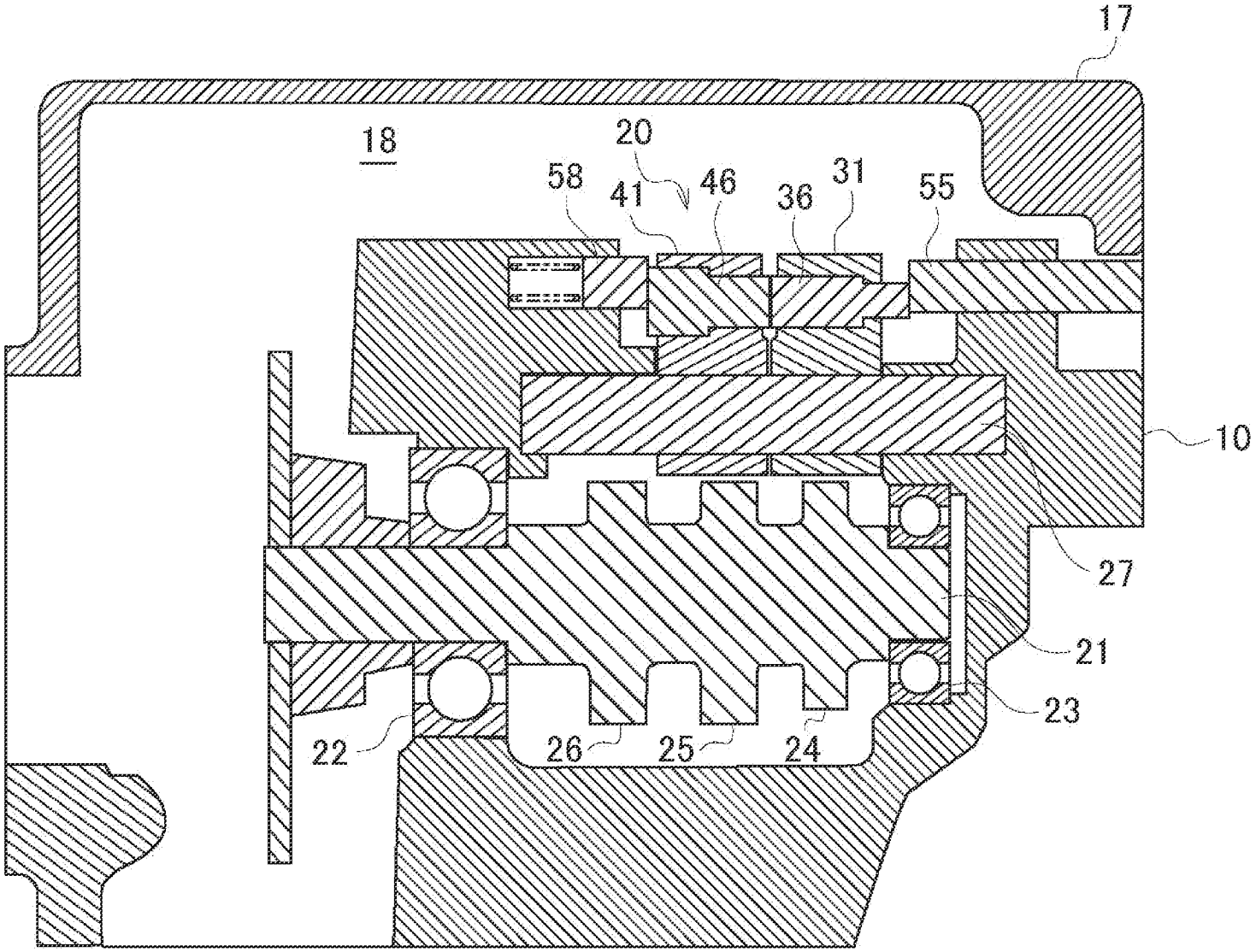
FIG. 2 is a schematic cross-sectional view taken along a line A-A of FIG. 1.

Hereinafter, a variable valve apparatus according to a first embodiment will be described with reference to the accompanying drawings. FIG. 1 is a schematic cross-sectional view of a cylinder head and a head cover according to the first embodiment. FIG. 2 is a schematic cross-sectional view taken along a line A-A of FIG. 1.

As shown in FIGS. 1 and 2, a cylinder head 10 is provided with a pair of (only one is shown) intake valves 12 that open and close an intake port 11, and a single exhaust valve 15 that opens and closes an exhaust port 14. The pair of intake valves 12 are pressed in a valve-closing direction by a valve spring 13, and the exhaust valve 15 is pressed in the valve-closing direction by a valve spring 16. A cylinder head cover 17 is attached to an upper surface of the cylinder head 10, and a valve-operating chamber 18 is formed by the cylinder head 10 and the cylinder head cover 17. A variable valve apparatus 20 that varies a valve operation in the cylinder head 10 is mounted on the valve-operating chamber 18.

The variable valve apparatus 20 is provided with a camshaft 21 common to an intake side and an exhaust side, and rocker shafts 27 and 28 parallel to the camshaft 21 respectively on the intake side and the exhaust side. The camshaft 21 is rotatably supported by bearings 22 and 23 in the cylinder head 10. The camshaft 21 is disposed between the intake valves 12 and the exhaust valve 15, and a stop cam 24, an intake cam 25, and an exhaust cam 26 are attached to an outer peripheral surface of the camshaft 21. The stop cam 24 is formed in a substantially disk shape of only a base circle, and the intake cam 25 and the exhaust cam 26 are formed in a plate shape in which a cam crest protrudes from a part of the base circle.

The rocker shafts 27 and 28 respectively on the intake side and the exhaust side are attached to the cylinder head 10 above the camshaft 21. A pair of rocker arms 31 and 41 are swingably supported by the rocker shaft 27 on the intake side, and a single rocker arm 51 is swingably supported by the rocker shaft 28 on the exhaust side. The pair of rocker arms 31 and 41 on the intake side and the rocker arm 51 on the exhaust side are seesaw-type rocker arms. One end of each of the rocker arms 31, 41, and 51 serves as a force point for receiving an input from the camshaft 21, and the other end of each of the rocker arms 31, 41, and 51 serves as a working point for operating the valve.

A roller 32, which is in rolling contact with the stop cam 24, is rotatably supported by the one end of the rocker arm 31, and the intake valves 12 are coupled to the other end of the rocker arm 31. A roller (not shown), which is in rolling contact with the intake cam 25, is rotatably supported by the one end of the rocker arm 41, and an intake valve (not shown) is coupled to the other end of the rocker arm 41. A roller 52, which is in rolling contact with the exhaust cam 26, is rotatably supported by the one end of the rocker arm 51, and the exhaust valve 15 is coupled to the other end of the rocker arm 51. The pair of rocker arms 31 and 41 are adjacent to each other, and the rocker arms 31 and 41 are formed so as to be able to be coupled to each other.

When an engine is rotated at a low speed or a medium speed, the pair of rocker arms 31 and 41 on the intake side are not coupled. Since a cam profile of the stop cam 24 is substantially circular, the rocker arm 31 does not swing even when the stop cam 24 is rotated, and operations of the intake valves 12 are stopped. The rocker arm 41 is swung in accordance with rotation of the intake cam 25, and only the intake valve (not shown) on one side is opened and closed. When the engine is rotated at a high speed, the pair of rocker arms 31 and 41 on the intake side are coupled to each other. The pair of rocker arms 31 and 41 are integrally swung in accordance with the rotation of the intake cam 25, and the pair of intake valves 12 are simultaneously opened and closed.

The variable valve apparatus 20 is formed with a structure capable of switching a state between a coupled state and a released state of the pair of rocker arms 31 and 41. Housing holes are formed in the pair of rocker arms 31 and 41, and a coupling pin 36 is disposed in the housing hole of the rocker arm 31. A part of the coupling pin 36 protrudes from the housing hole of the rocker arm 31 into the housing hole of the rocker arm 41, so that the pair of rocker arms 31 and 41 are coupled to each other via the coupling pin 36. A part of the coupling pin 36 is pushed back from the housing hole of the rocker arm 41 into the housing hole of the rocker arm 31, so that the coupling between the pair of rocker arms 31 and 41 is released.

In the variable valve apparatus 20, a repulsive force of a spring is used to push back the coupling pin 36 into the housing hole of the rocker arm 31. In this case, when the spring is disposed in the housing hole of the rocker arm 41, the spring swings together with the rocker arm 41, causing various problems. For example, breakage of the spring, wear of peripheral members of the spring, and the like due to resonance during operation of the engine may occur. Further, when the spring is disposed in the rocker arm 41, a mass of a moving part of a variable valve system increases, and thus may not be suitable for a high-speed engine. Furthermore, a size of the rocker arm 41 itself may also be increased, which may lead to an increase in a size and a weight of the variable valve apparatus 20.

Therefore, the variable valve apparatus 20 of the present embodiment is configured such that the spring is disposed on an outer side of the rocker arm 41 and the repulsive force of the spring is transmitted from the outer side of the rocker arm 41 to the coupling pin 36. At this time, an arrangement position of the spring in the cylinder head 10 and the like are devised such that the structure of the variable valve apparatus 20 is not complicated and the variable valve apparatus 20 is not increased in the size. Accordingly, even when no spring is disposed in the rocker arm 41, the coupled state and the released state of the rocker arms 31 and 41 can be switched by a simple configuration. Since the spring does not swing together with the rocker arm 41, the above-described problems do not occur.

Figure 3A:
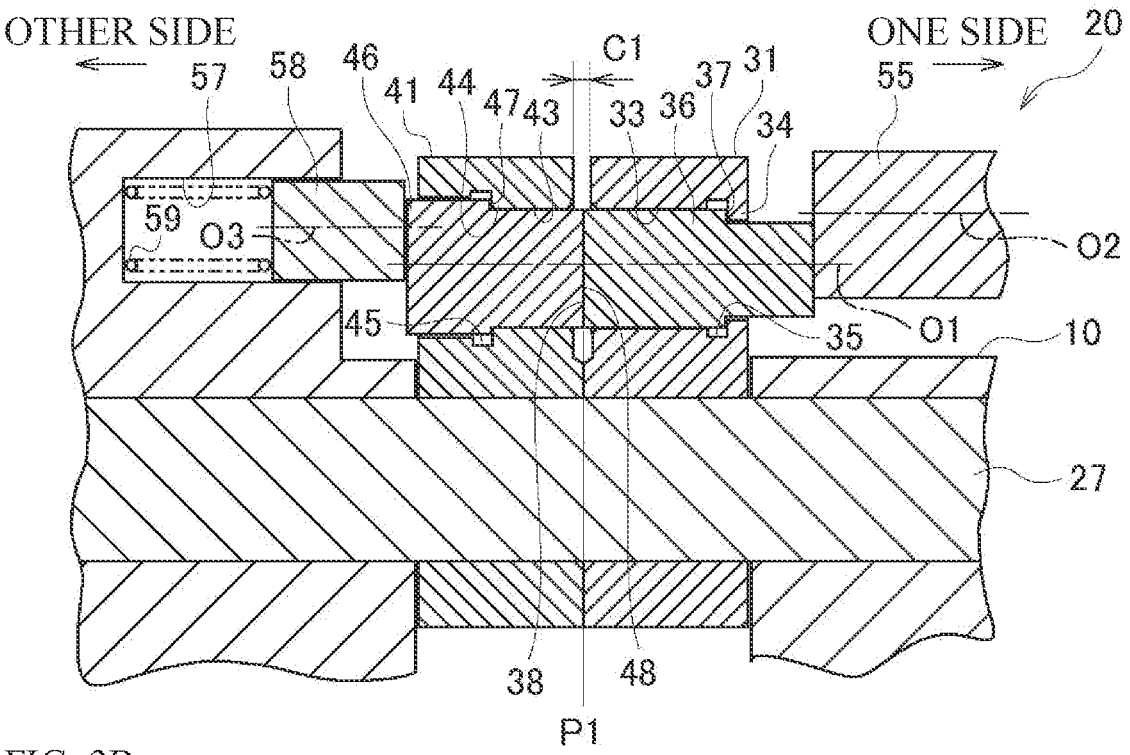
FIGS. 3A and 3B are schematic views of a coupling structure of a pair of rocker arms according to the first embodiment.
Figure 3B:
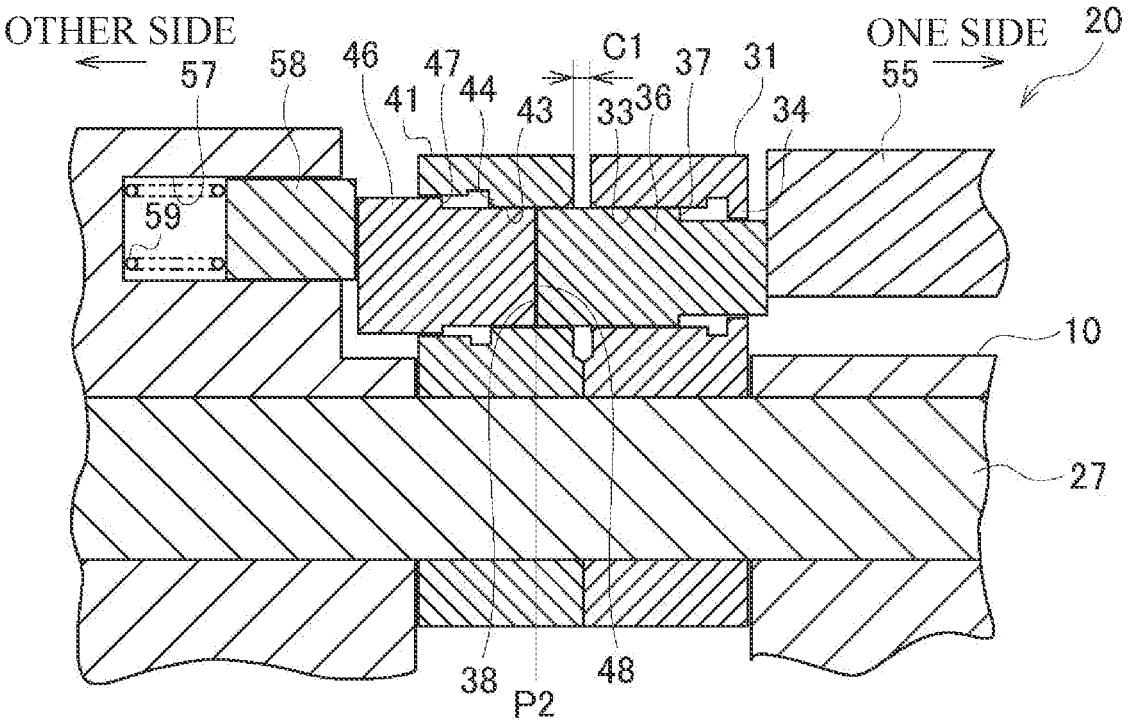

Hereinafter, a coupling structure of the pair of rocker arms according to the first embodiment will be described with reference to FIGS. 3A and 3B. FIGS. 3A and 3B are schematic views of the coupling structure of the pair of rocker arms according to the first embodiment. FIG. 3A shows the released state of the pair of rocker arms. FIG. 3B shows the coupled state of the pair of rocker arms.

As shown in FIG. 3A, the rocker shaft 27 extends from one side to the other side inside the cylinder head 10. The pair of rocker arms 31 and 41 are supported by the rocker shaft 27, and the pair of rocker arms 31 and 41 can swing around an axis of the rocker shaft 27. The pair of rocker arms 31 and 41 are arranged adjacent to each other on the rocker shaft 27, and upper portions of the pair of rocker arms 31 and 41 face each other with a slight gap C1 therebetween. Housing holes 33 and 43 parallel to the rocker shaft 27 are formed in the upper portions of the pair of rocker arms 31 and 41.

A stopper 34 obtained by narrowing a hole diameter of the housing hole 33 is formed on one end portion of the housing hole 33 of the rocker arm 31. An annular groove 35 is formed in an inner peripheral surface of the housing hole 33 on the other end side of the stopper 34. A stopper 44 is formed in a substantially half portion on one side of the housing hole 43 of the rocker arm 41 by narrowing a hole diameter of the housing hole 43. An annular groove 45 is formed in an inner peripheral surface of the housing hole 43 on the other end side of the stopper 44. A hole diameter on the other end side of the housing hole 33 and a hole diameter on one end side of the housing hole 43 match each other, and the housing hole 33 and the housing hole 43 are coaxially formed so as to communicate with each other in a valve closed state of the pair of intake valves 12 (see FIG. 1).

The coupling pin 36 is disposed in the housing hole 33 of the rocker arm 31 so as to be movable in an axial direction. The coupling pin 36 is a stepped pin including a large-diameter portion and a small-diameter portion, and the small-diameter portion of the coupling pin 36 protrudes from the rocker arm 31 to one side. A step 37 is formed on a boundary between the large-diameter portion and the small-diameter portion on an outer peripheral surface of the coupling pin 36, and the step 37 of the coupling pin 36 abuts against the stopper 34 of the rocker arm 31, so that movement of the coupling pin 36 to one side is restricted. In the released state of the pair of rocker arms 31 and 41, the coupling pin 36 is positioned at an initial position (release position) where the step 37 and the stopper 34 are in contact with each other.

A release pin 46 is disposed in the housing hole 43 of the rocker arm 41 so as to be movable in the axial direction. The release pin 46 is a stepped pin including a large-diameter portion and a small-diameter portion, and the other end portion of the large-diameter portion of the release pin 46 protrudes from the rocker arm 41 to the other end side. A step 47 is formed on a boundary between the large-diameter portion and the small-diameter portion on an outer peripheral surface of the release pin 46, and the step 47 of the release pin 46 abuts against the stopper 44 of the rocker arm 41, so that movement of the release pin 46 to one side is restricted. In the released state of the pair of rocker arms 31 and 41, the release pin 46 is positioned at an initial position where the step 47 and the stopper 44 are in contact with each other.

In the cylinder head 10, a pressing member 55 is disposed on one side of the rocker arm 31. The pressing member 55 is formed of a solenoid pin, a push rod, a hydraulic pressure plunger, or the like. The other end of the pressing member 55 is in contact with the coupling pin 36, and the coupling pin 36 is pushed in toward the other side by the pressing member 55. A guide hole 57 is formed in the cylinder head 10 on the other side of the rocker arm 41. A transmission member 58 is disposed in the guide hole 57. A straight pin is used as the transmission member 58. One end of the transmission member 58 is in contact with the release pin 46, and the release pin 46 is pushed back to one side by the transmission member 58.

In the guide hole 57 of the cylinder head 10, a repulsive spring (push-back member) 59 is disposed so as to be in contact with the transmission member 58 from the other side. A coil spring disposed coaxially with the transmission member 58 is used as the repulsive spring 59. One end of the repulsive spring 59 is in contact with the transmission member 58, and the other end of the repulsive spring 59 is in contact with a bottom wall of the guide hole 57. When the transmission member 58 is pushed into the guide hole 57 from one side, a repulsive force is accumulated in the repulsive spring 59, and when the pushing of the transmission member 58 is released, the transmission member 58 is pushed back to the one side by the repulsive force of the repulsive spring 59. The pins 36 and 46 are automatically returned by the repulsive force of the repulsive spring 59 via the transmission member 58.

Since the repulsive spring 59 is disposed in the cylinder head 10, the repulsive spring 59 does not swing together with the rocker arm 41. Therefore, breakage of the repulsive spring 59, wear of peripheral members of the repulsive spring 59, and the like due to resonance during the operation of the engine can be suppressed. The moving part of the variable valve system around the rocker arm 41 is reduced in a size and a weight, so that it is possible to cope with a higher engine speed as compared with a related-art engine. Further, the rocker arm 41 does not become large, and there is no need to add a new component for disposing the repulsive spring 59. Therefore, the increase in the size and the weight of the variable valve apparatus 20 is suppressed.

A central axis O1 of the coupling pin 36 and the release pin 46 is closer to the rocker shaft 27 than a central axis O2 of the pressing member 55 and a central axis O3 of the transmission member 58, and the upper portions of a plurality of rocker arms 31 and 41 are reduced in sizes. An offset amount of the central axis O1 of the coupling pin 36 and the central axis O2 of the pressing member 55 is preferably set to such an extent that a contact area between the coupling pin 36 and the pressing member 55 is secured and an axial deviation of the coupling pin 36 can be suppressed. An offset amount of the central axis O1 of the release pin 46 and the central axis O3 of the transmission member 58 is preferably set to such an extent that a contact area between the release pin 46 and the transmission member 58 is secured and an axial deviation of the release pin 46 can be suppressed.

In the released state of the pair of rocker arms 31 and 41, a pressing force is not applied from the pressing member 55 to the coupling pin 36, and a spring force of the repulsive spring 59 is applied to the release pin 46 via the transmission member 58. The step 37 of the coupling pin 36 abuts against the stopper 34 of the rocker arm 31, and the step 47 of the release pin 46 abuts against the stopper 44 of the rocker arm 41. At this time, the other end 38 of the coupling pin 36 is in contact with one end 48 of the release pin 46 at a non-coupling position P1 of the gap C1 between the pair of rocker arms 31 and 41. The other end 38 of the coupling pin 36 is positioned outside the rocker arm 41, and the pair of rocker arms 31 and 41 are separated from each other.

As shown in FIG. 3B, when the coupling pin 36 is pushed in by the pressing member 55, the transmission member 58 is moved to the other side by the coupling pin 36 via the release pin 46. The transmission member 58 is pushed into the guide hole 57 of the cylinder head 10, the repulsive spring 59 is contracted by the transmission member 58, and the repulsive force is accumulated in the repulsive spring 59. The other end 38 of the coupling pin 36 is moved to the other side from the non-coupling position P1 to a coupling position P2 in the housing hole 43 of the rocker arm 41. When a part of the coupling pin 36 enters the housing hole 43 of the rocker arm 41, the pair of rocker arms 31 and 41 are coupled to each other via the coupling pin 36.

As shown in FIG. 3A, when the pushing in of the coupling pin 36 by the pressing member 55 is released, the transmission member 58 is pushed back by the repulsive force of the repulsive spring 59. The release pin 46 is pushed in by the transmission member 58, and the coupling pin 36 is pushed back to the one side by the release pin 46. The other end 38 of the coupling pin 36 is moved to the one side from the coupling position P2 to the non-coupling position P1, and the release pin 46 and the coupling pin 36 are respectively returned to the original positions. When a part of the coupling pin 36 comes out of the housing hole 43 of the rocker arm 41, the coupling between the pair of rocker arms 31 and 41 is released.

When the pair of rocker arms 31 and 41 are coupled, the coupling pin 36 is pushed into the housing hole 43 of the rocker arm 41 by the pressing member 55 while the release pin 46 is pushed out to the other side against the repulsive force of the repulsive spring 59. When the coupling between the pair of rocker arms 31 and 41 is released, the transmission member 58 is pushed back by the repulsive force of the repulsive spring 59, and the coupling pin 36 is pushed back into the housing hole 33 of the rocker arm 31 via the release pin 46 by the transmission member 58. The coupling pin 36 is moved between the non-coupling position P1 and the coupling position P2, and the coupled state and the released state of the pair of rocker arms 31 and 41 are switched.

As described above, according to the variable valve apparatus 20 of the first embodiment, even when the repulsive spring 59 is disposed in the cylinder head 10, the coupled state and the released state of the pair of rocker arms 31 and 41 are switched by a simple configuration. Further, the breakage of the repulsive spring 59, the wear of the peripheral members of the repulsive spring 59, and the like due to the resonance during the operation of the engine can be suppressed, and a relatively high engine speed can be coped with. Further, the increase in the size and the weight of the variable valve apparatus 20 is suppressed.

Second Embodiment

Figure 4A:
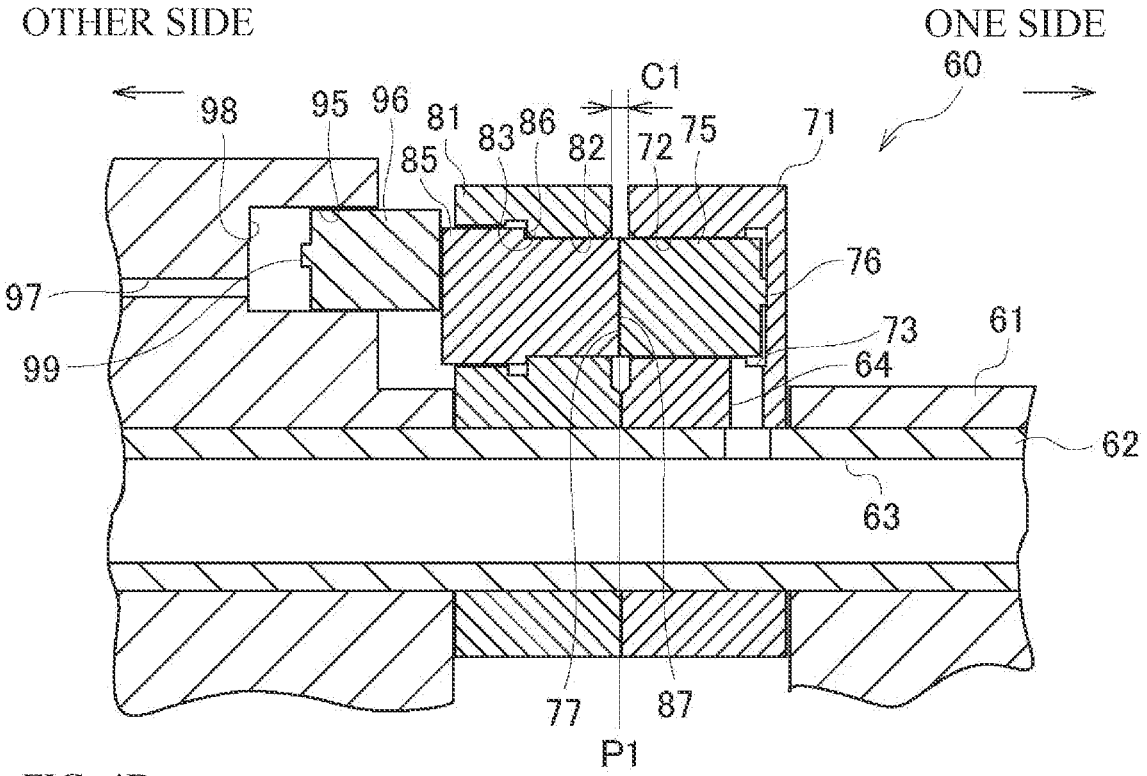
FIGS. 4A and 4B are schematic views of a coupling structure of a pair of rocker arms according to a second embodiment.
Figure 4B:
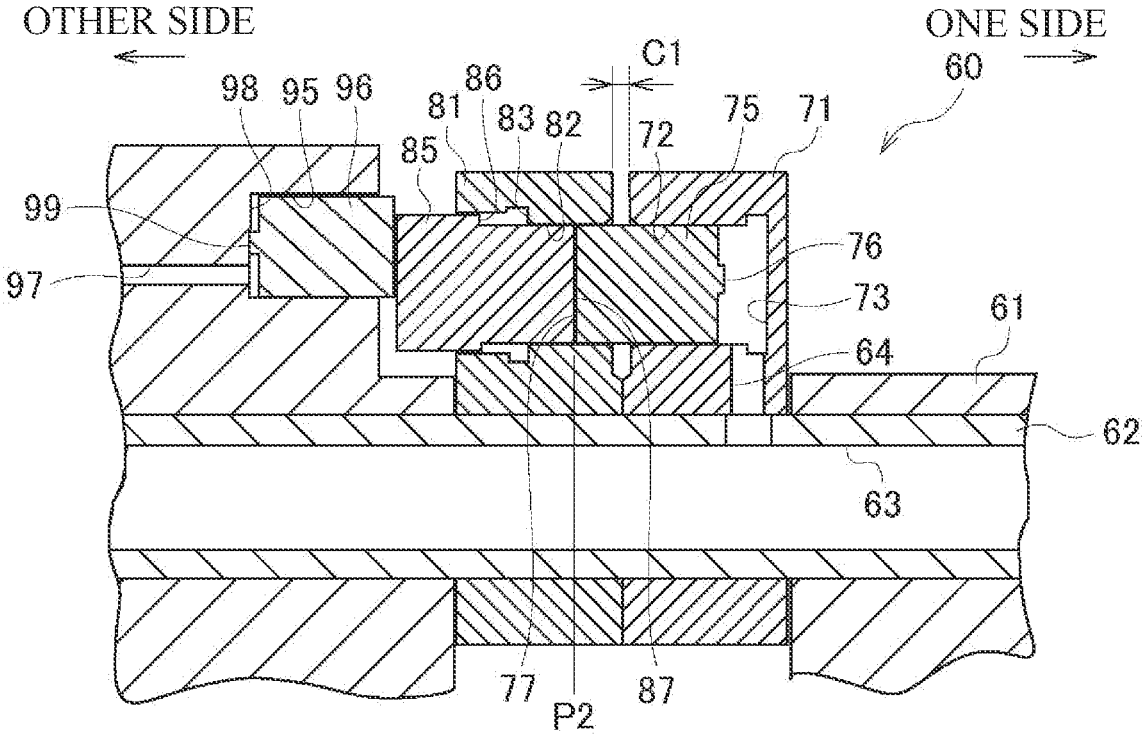

Next, a variable valve apparatus according to a second embodiment will be described with reference to FIGS. 4A and 4B. The variable valve apparatus according to the second embodiment is different from the variable valve apparatus according to the first embodiment in that a hydraulic pressure cylinder is formed in a rocker arm on one side as a pressing member and a hydraulic pressure cylinder is formed in a cylinder head as a push-back member. Therefore, in the second embodiment, description of the same configuration as that of the first embodiment will be omitted. FIGS. 4A and 4B are schematic views of a coupling structure of a pair of rocker arms according to the second embodiment. FIG. 4A shows a released state of the pair of rocker arms. FIG. 4B shows a coupled state of the pair of rocker arms.

As shown in FIG. 4A, a rocker shaft 62 extends from one side to the other side inside a cylinder head 61, and a pair of rocker arms 71 and 81 are swingably supported by the rocker shaft 62. An oil passage 63 is formed inside the rocker shaft 62, and a hydraulic pressure chamber 73 is formed on one end side of the rocker arm 71. An oil hole 64 that connects the oil passage 63 and the hydraulic pressure chamber 73 is formed in a peripheral wall of the rocker shaft 62 and the rocker arm 71, and oil is supplied from the oil passage 63 to the hydraulic pressure chamber 73 via the oil hole 64. In this way, the rocker arm 71 is formed with the hydraulic pressure cylinder that pushes a coupling pin 75 in toward the other side.

Housing holes 72 and 82 parallel to the rocker shaft 62 are formed in the pair of rocker arms 71 and 81. One end side of the housing hole 72 of the rocker arm 71 is the hydraulic pressure chamber 73 into which the oil enters, and the coupling pin 75 disposed in the housing hole 72 functions as a drive plunger. The housing hole 72 (hydraulic pressure chamber 73) of the rocker arm 71 is formed in a bottomed tubular shape, and a protrusion 76 is formed on one end of the coupling pin 75. When the protrusion 76 of the coupling pin 75 abuts against an inner bottom surface of the hydraulic pressure chamber 73, movement of the coupling pin 75 to one side is restricted, and a minimum volume of the hydraulic pressure chamber 73 is secured.

A hydraulic pressure cylinder is formed in the cylinder head 61 on the other side of the rocker arm 81. A transmission member 96 is disposed in a guide hole 95 of the cylinder head 61, and an oil passage 97 is connected to a bottom surface of the guide hole 95. That is, the other end side of the guide hole 95 of the cylinder head 61 is a hydraulic pressure chamber 98 into which oil enters, and the transmission member 96 disposed in the guide hole 95 functions as a return plunger. A protrusion 99 is formed on the other end of the transmission member 96. When the protrusion 99 of the transmission member 96 abuts against an inner bottom surface of the hydraulic pressure chamber 98, movement of the transmission member 96 to the other side is restricted, and a minimum volume of the hydraulic pressure chamber 98 is secured.

In the released state of the pair of rocker arms 71 and 81, a hydraulic pressure is not applied from the hydraulic pressure chamber 73 of the rocker arm 71 to the coupling pin 75, and a hydraulic pressure is not applied from the hydraulic pressure chamber 98 of the cylinder head 61 to the transmission member 96. The protrusion 76 of the coupling pin 75 abuts against the inner bottom surface of the hydraulic pressure chamber 73, and a step 86 of a release pin 85 abuts against a stopper 83 of the rocker arm 81. At this time, the other end 77 of the coupling pin 75 is in contact with one end 87 of the release pin 85 at the non-coupling position P1 of the gap C1 between the pair of rocker arms 71 and 81. The other end 77 of the coupling pin 75 is positioned outside the rocker arm 81, and the pair of rocker arms 71 and 81 are separated from each other.

As shown in FIG. 4B, when the hydraulic pressure is applied to the coupling pin 75 from the hydraulic pressure chamber 73 of the rocker arm 71, the transmission member 96 is moved to the other side by the coupling pin 75 via the release pin 85. The transmission member 96 is pushed into the guide hole 95 of the cylinder head 61, and the protrusion 99 of the transmission member 96 abuts against the inner bottom surface of the hydraulic pressure chamber 98. The other end 77 of the coupling pin 75 is moved to the other side from the non-coupling position P1 to the coupling position P2 of the rocker arm 81. When a part of the coupling pin 75 enters the housing hole 82 of the rocker arm 81, the pair of rocker arms 71 and 81 are coupled to each other via the coupling pin 75.

As shown in FIG. 4A, when the hydraulic pressure applied to the coupling pin 75 is released, the transmission member 96 is pushed back by the hydraulic pressure in the hydraulic pressure chamber 98 of the cylinder head 61. The release pin 85 is pushed in by the transmission member 96, and the coupling pin 75 is pushed back to the one side by the release pin 85. The other end 77 of the coupling pin 75 is moved to the one side from the coupling position P2 to the non-coupling position P1, and the release pin 85 and the coupling pin 75 are respectively returned to the original positions. When a part of the coupling pin 75 comes out of the housing hole 82 of the rocker arm 81, the coupling between the pair of rocker arms 71 and 81 is released.

As described above, according to the variable valve apparatus 60 of the second embodiment, the coupled state and the released state of the pair of rocker arms 71 and 81 are switched by a simple configuration that uses the hydraulic pressure. Further, since the repulsive spring is not used, problems such as the breakage of the repulsive spring do not occur.

In the second embodiment, the hydraulic pressure cylinder for pressing is formed in one rocker arm, and the hydraulic pressure cylinder for performing pushing back is formed in the cylinder head, but the hydraulic pressure cylinder may be formed in at least one of the rocker arm and the cylinder head. That is, the hydraulic pressure cylinder may be formed in one rocker arm instead of a pressing member, and a repulsive spring may be disposed in the guide hole of the cylinder head as a push-back member. Further, a solenoid pin or the like may be used as the pressing member, and the hydraulic pressure cylinder may be formed in the cylinder head as the push-back member.

Third Embodiment

Figure 5A:
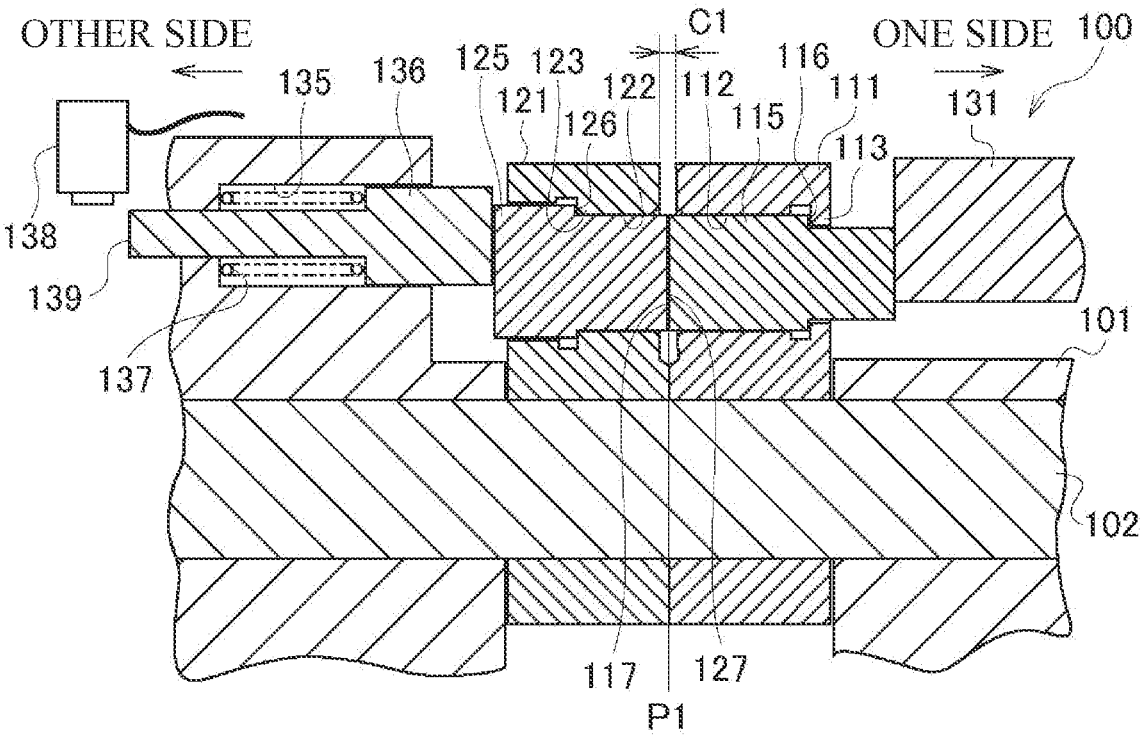
FIGS. 5A and 5B are schematic views of a coupling structure of a pair of rocker arms according to a third embodiment.
Figure 5B:
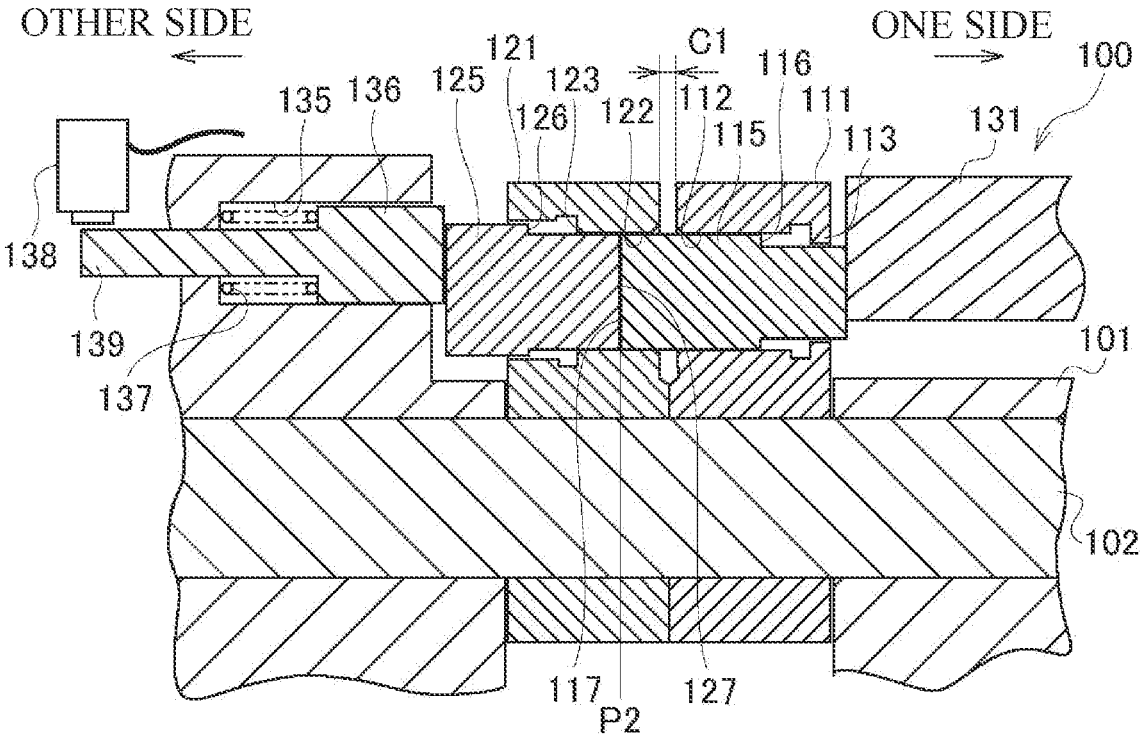

Next, a variable valve apparatus according to a third embodiment will be described with reference to FIGS. 5A and 5B. A variable valve apparatus of the third embodiment is different from the variable valve apparatus of the first embodiment in that a sensor that can detect a coupled state and a released state of a pair of rocker arms is provided. Therefore, in the third embodiment, description of the same configuration as that of the first embodiment will be omitted. FIGS. 5A and 5B are schematic views of a coupling structure of the pair of rocker arms according to the third embodiment. FIG. 5A shows the released state of the pair of rocker arms. FIG. 5B shows the coupled state of the pair of rocker arms.

As shown in FIG. 5A, a rocker shaft 102 extends from one side to the other side inside a cylinder head 101, and a pair of rocker arms 111 and 121 are swingably supported by the rocker shaft 102. A coupling pin 115 is disposed in a housing hole 112 of the rocker arm 111, and a release pin 125 is disposed in a housing hole 122 of the rocker arm 121. A pressing member 131 is disposed on one side of the rocker arm 111, and a guide hole 135 is formed in the cylinder head 101 on the other side of the rocker arm 121. A transmission member 136 and a repulsive spring 137 are disposed in the guide hole 135. A sensor 138 is disposed on the other side of the repulsive spring 137.

A rod 139 that extends toward the sensor 138 is formed on the other end of the transmission member 136. The rod 139 extends to the other side through an inside of the coil-shaped repulsive spring 137, and passes through a portion where the guide hole 135 of the cylinder head 101 is formed. The sensor 138 is disposed in the vicinity of a tip end of the rod 139, and a detection direction of the sensor 138 and an extension direction of the rod 139 are orthogonal to each other. The sensor 138 detects the coupled state and the released state of the rocker arms 111 and 121 based on movement of the tip end of the rod 139. A command signal from a control unit (not shown) to a variable valve apparatus 100 is compared with a detection signal of the sensor 138 to detect a malfunction of the variable valve apparatus 100.

In the released state of the pair of rocker arms 111 and 121, a pressing force is not applied from the pressing member 131 to the coupling pin 115, and a spring force of the repulsive spring 137 is applied to the release pin 125 via the transmission member 136. A step 116 of the coupling pin 115 abuts against a stopper 113 of the rocker arm 111, and a step 126 of the release pin 125 abuts against a stopper 123 of the rocker arm 121. At this time, the other end 117 of the coupling pin 115 is in contact with one end 127 of the release pin 125 at the non-coupling position P1 of the gap C1 between the pair of rocker arms 111 and 121. The other end 117 of the coupling pin 115 is positioned outside the rocker arm 121, and the pair of rocker arms 111 and 121 are separated from each other.

As shown in FIG. 5B, when the coupling pin 115 is pushed in by the pressing member 131, the transmission member 136 is moved to the other side by the coupling pin 115 via the release pin 125. The transmission member 136 is pushed into the guide hole 135 of the cylinder head 101, the repulsive spring 137 is contracted by the transmission member 136, and a repulsive force is accumulated in the repulsive spring 137. The other end 117 of the coupling pin 115 is moved to the other side from the non-coupling position P1 to the coupling position P2 of the rocker arm 121. When a part of the coupling pin 115 enters the housing hole 122 of the rocker arm 121, the pair of rocker arms 111 and 121 are coupled to each other via the coupling pin 115.

At this time, as the transmission member 136 is moved to the other side, the tip end of the rod 139 is positioned at a detection position of the sensor 138. When the tip end of the rod 139 is detected by the sensor 138, the control unit determines that the variable valve apparatus 100 operates in accordance with a coupling command. In contrast, when the tip end of the rod 139 is not detected by the sensor 138, the control unit determines that the variable valve apparatus 100 does not operate in accordance with the coupling command. A malfunction of the variable valve apparatus 100 such as locking of the coupling pin 115 and the release pin 125 is detected, and a malfunction indicator lamp (MIL) is turned on to notify a driver of the malfunction.

As shown in FIG. 5A, when the pushing in of the coupling pin 115 by the pressing member 131 is released, the transmission member 136 is pushed back by a repulsive force of the repulsive spring 137. The release pin 125 is pushed in by the transmission member 136, and the coupling pin 115 is pushed back to one side by the release pin 125. The other end 117 of the coupling pin 115 is moved to the one side from the coupling position P2 to the non-coupling position P1, and the release pin 125 and the coupling pin 115 are respectively returned to the original positions. When a part of the coupling pin 115 comes out of the housing hole 122 of the rocker arm 121, the coupling between the pair of rocker arms 111 and 121 is released.

At this time, as the transmission member 136 is moved to the one side, the tip end of the rod 139 is removed from the detection position of the sensor 138. When the tip end of the rod 139 is not detected by the sensor 138, the control unit determines that the variable valve apparatus 100 operates in accordance with a release command. In contrast, when the tip end of the rod 139 is detected by the sensor 138, the control unit determines that the variable valve apparatus 100 does not operate in accordance with the release command. The malfunction of the variable valve apparatus 100 such as the locking of the coupling pin 115 and the release pin 125 is detected, and the malfunction indicator lamp is turned on to notify the driver of the malfunction.

As described above, according to the variable valve apparatus 100 of the third embodiment, the coupled state and the released state of the pair of rocker arms 111 and 121 are switched by a simple configuration. As in the first embodiment, a problem such as breakage of the repulsive spring 137 does not occur. Further, the repulsive spring 137 and the sensor 138 are arranged in a compact manner, so that an increase in a size of the variable valve apparatus 100 is suppressed. Furthermore, the malfunction indicator lamp notifies the driver of a malfunction of the variable valve apparatus 100, and prevents a vehicle from continuing traveling in a state where exhaust gas deteriorates.

In the third embodiment, a solenoid pin or the like is used as the pressing member, but as long as a sensor is provided, the hydraulic pressure cylinder may be formed in one rocker arm instead of the pressing member.

In the third embodiment, an outer peripheral surface of the rod on a tip end side is formed straightly, but a shape of the outer peripheral surface of the rod on the tip end side is not particularly limited. For example, the outer peripheral surface of the rod on the tip end side may be formed in a tapered shape, or the outer peripheral surface of the rod on the tip end side may be formed in a tapered stepped shape.

In the third embodiment, a type of the sensor is not particularly limited, and for example, the sensor may be configured with a gap sensor, a contact switch, or a non-contact switch. Further, the detection direction of the sensor may be parallel to the extension direction of the rod.

Fourth Embodiment

Figure 6A:
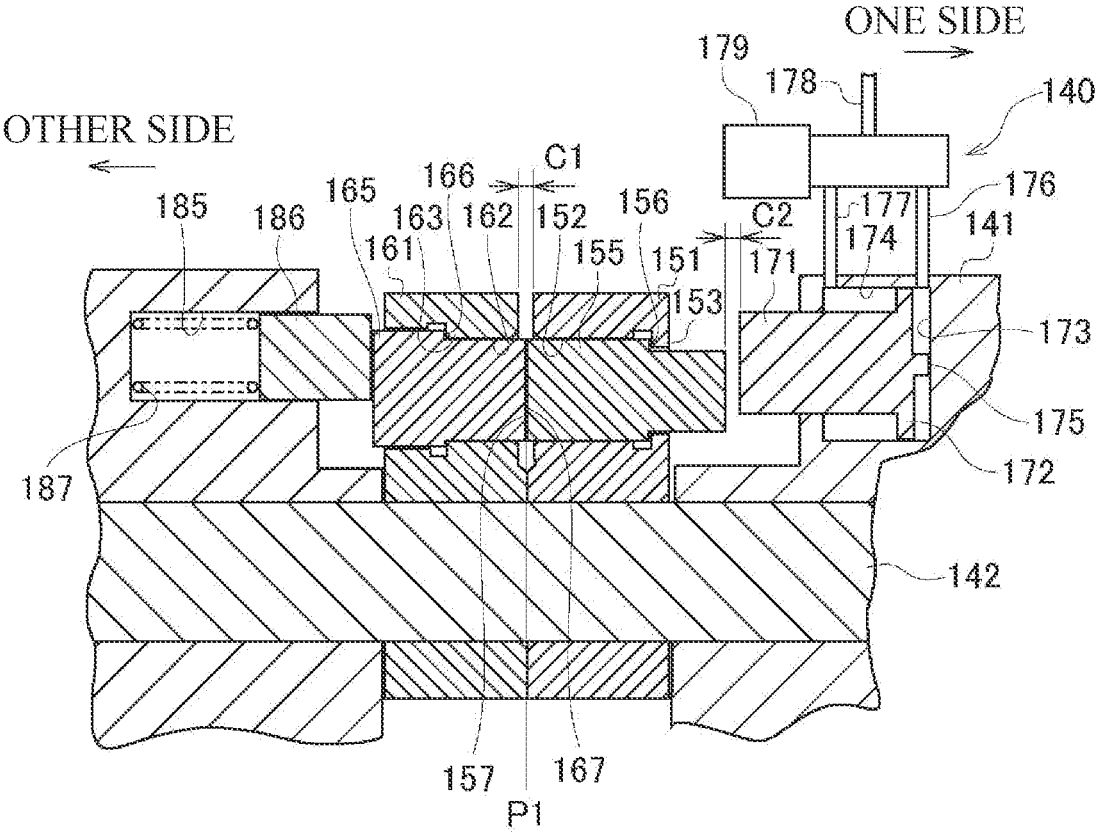
FIGS. 6A and 6B are schematic views of a coupling structure of a pair of rocker arms according to a fourth embodiment.
Figure 6B:
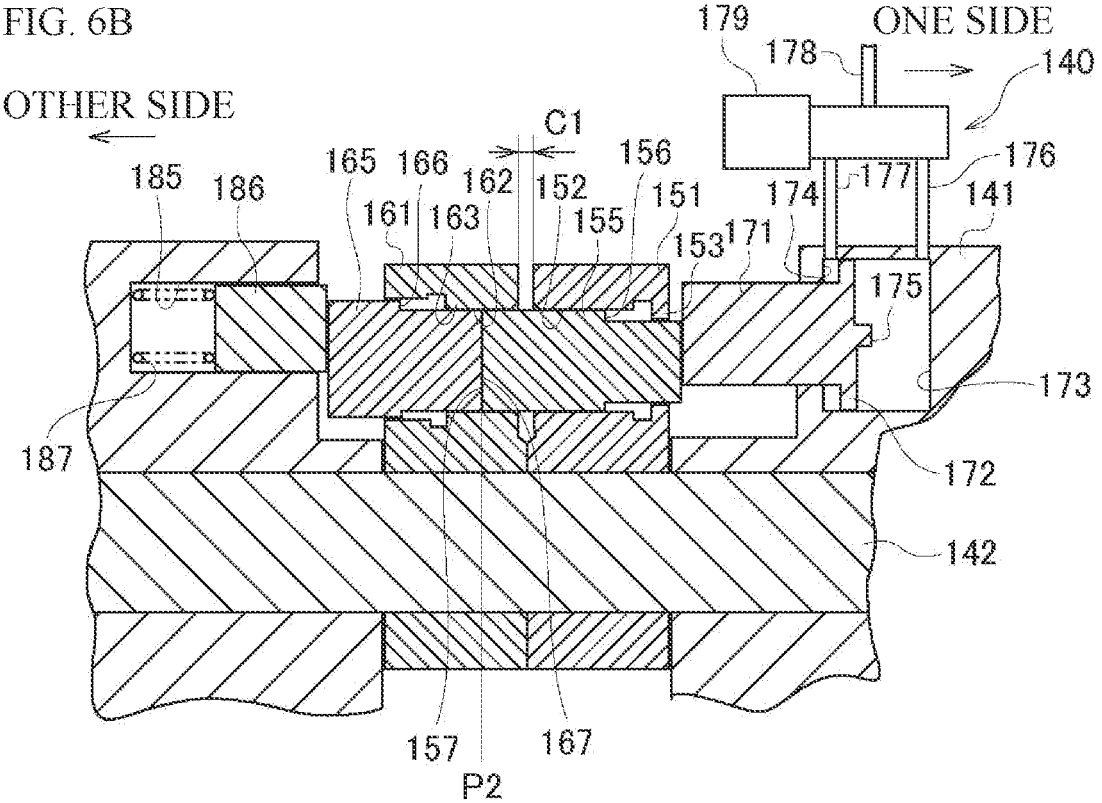

Next, a variable valve apparatus according to a fourth embodiment will be described with reference to FIGS. 6A and 6B. The variable valve apparatus of the fourth embodiment is different from the variable valve apparatus of the first embodiment in that a coupling pin and a pressing member are separated from each other in a released state of a pair of rocker arms. Therefore, in the fourth embodiment, description of the same configuration as that of the first embodiment will be omitted. FIGS. 6A and 6B are schematic views of a coupling structure of the pair of rocker arms according to the fourth embodiment. FIG. 6A shows the released state of the pair of rocker arms. FIG. 6B shows a coupled state of the pair of rocker arms.

As shown in FIG. 6A, a rocker shaft 142 extends from one side to the other side inside a cylinder head 141, and a pair of rocker arms 151 and 161 are swingably supported by the rocker shaft 142. A coupling pin 155 is disposed in a housing hole 152 of the rocker arm 151, and a release pin 165 is disposed in a housing hole 162 of the rocker arm 161. A pressing member 171 is disposed on one side of the rocker arm 151, and a guide hole 185 is formed in the cylinder head 141 on the other side of the rocker arm 161. A transmission member 186 and a repulsive spring 187 are arranged in the guide hole 185.

The pressing member 171 is formed by a hydraulic pressure plunger, and one end side of the pressing member 171 is disposed in a housing space formed in the cylinder head 141. In the released state of the pair of rocker arms 151 and 161, a gap C2 is formed between the coupling pin 155 and the pressing member 171. A flange 172 is formed on one end portion of the pressing member 171, and the housing space in the cylinder head 141 is partitioned into first and second hydraulic pressure chambers 173 and 174 by the flange 172. A protrusion 175 is formed on one end of the pressing member 171, and the protrusion 175 abuts against an inner bottom surface of the first hydraulic pressure chamber 173, so that movement of the pressing member 171 to one side is restricted, and a minimum volume of the first hydraulic pressure chamber 173 is secured.

The first hydraulic pressure chamber 173 is connected to an oil control valve 179 via a first oil passage 176, and the second hydraulic pressure chamber 174 is connected to the oil control valve 179 via a second oil passage 177. Oil is supplied to the oil control valve 179 via a third oil passage 178. When oil is supplied from the oil control valve 179 to the first hydraulic pressure chamber 173, the pressing member 171 is ejected toward the coupling pin 155 by a hydraulic pressure of the first hydraulic pressure chamber 173. When the oil is supplied from the oil control valve 179 to the second hydraulic pressure chamber 174, the pressing member 171 is retracted from the coupling pin 155 by a hydraulic pressure of the second hydraulic pressure chamber 174.

In the released state of the pair of rocker arms 151 and 161, the pressing member 171 and the coupling pin 155 are separated from each other with the gap C2 therebetween, and the transmission member 186 pushed out by the repulsive spring 187 is in contact with the release pin 165. A step 156 of the coupling pin 155 abuts against a stopper 153 of the rocker arm 151, and a step 166 of the release pin 165 abuts against a stopper 163 of the rocker arm 161. At this time, the other end 157 of the coupling pin 155 is in contact with one end 167 of the release pin 165 at the non-coupling position P1 of the gap C1 between the pair of rocker arms 151 and 161. The other end 157 of the coupling pin 155 is positioned outside the rocker arm 161, and the pair of rocker arms 151 and 161 are separated from each other.

As shown in FIG. 6B, when the oil is supplied from the oil control valve 179 to the first hydraulic pressure chamber 173, the pressing member 171 is ejected toward the coupling pin 155 facing the pressing member 171 with the gap C2 sandwiched therebetween. When the pressing member 171 collides with the coupling pin 155, the transmission member 186 is quickly moved to the other side via the release pin 165 by an impact. The transmission member 186 is pushed into the guide hole 185 of the cylinder head 141, and the impact between the pressing member 171 and the coupling pin 155 is absorbed by the repulsive spring 187 via the transmission member 186. In this way, the repulsive spring 187 functions not only as a push back of the transmission member 186 but also as a buffer material.

Then, the other end 157 of the coupling pin 155 is moved to the other side from the non-coupling position P1 to the coupling position P2 of the rocker arm 161. When a part of the coupling pin 155 enters the housing hole 162 of the rocker arm 161, the pair of rocker arms 151 and 161 are coupled to each other via the coupling pin 155. The pair of rocker arms 151 and 161 are quickly coupled to each other by the impact between the pressing member 171 and the coupling pin 155, so that it is possible to cope with the high rotation speed of the engine. The gap C2 between the pressing member 171 and the coupling pin 155 is preferably set to a size of 25% or more of a stroke of the coupling pin 155.

As shown in FIG. 6A, when the oil is supplied from the oil control valve 179 to the second hydraulic pressure chamber 174, the pressing member 171 is retracted from the coupling pin 155, and the transmission member 186 is pushed back by a repulsive force of the repulsive spring 187. The release pin 165 is pushed in by the transmission member 186, and the coupling pin 155 is pushed back to the one side by the release pin 165. The other end 157 of the coupling pin 155 is moved to the one side from the coupling position P2 to the non-coupling position P1, and the release pin 165 and the coupling pin 155 are respectively returned to the original positions. When a part of the coupling pin 155 comes out of the housing hole 162 of the rocker arm 161, the coupling between the pair of rocker arms 151 and 161 is released.

As described above, according to the variable valve apparatus 140 of the fourth embodiment, the coupled state and the released state of the pair of rocker arms 151 and 161 are switched by a simple configuration. As in the first embodiment, a problem such as breakage of the repulsive spring 187 does not occur. Further, since the plurality of rocker arms 151 and 161 are quickly coupled to each other, it is possible to cope with the high rotation speed of the engine.

In the fourth embodiment, the hydraulic pressure plunger connected to the oil control valve is used as the pressing member, but as long as there is the gap between the pressing member and the coupling pin, a solenoid pin or the like may be used as the pressing member.

Fifth Embodiment

Figure 7A:
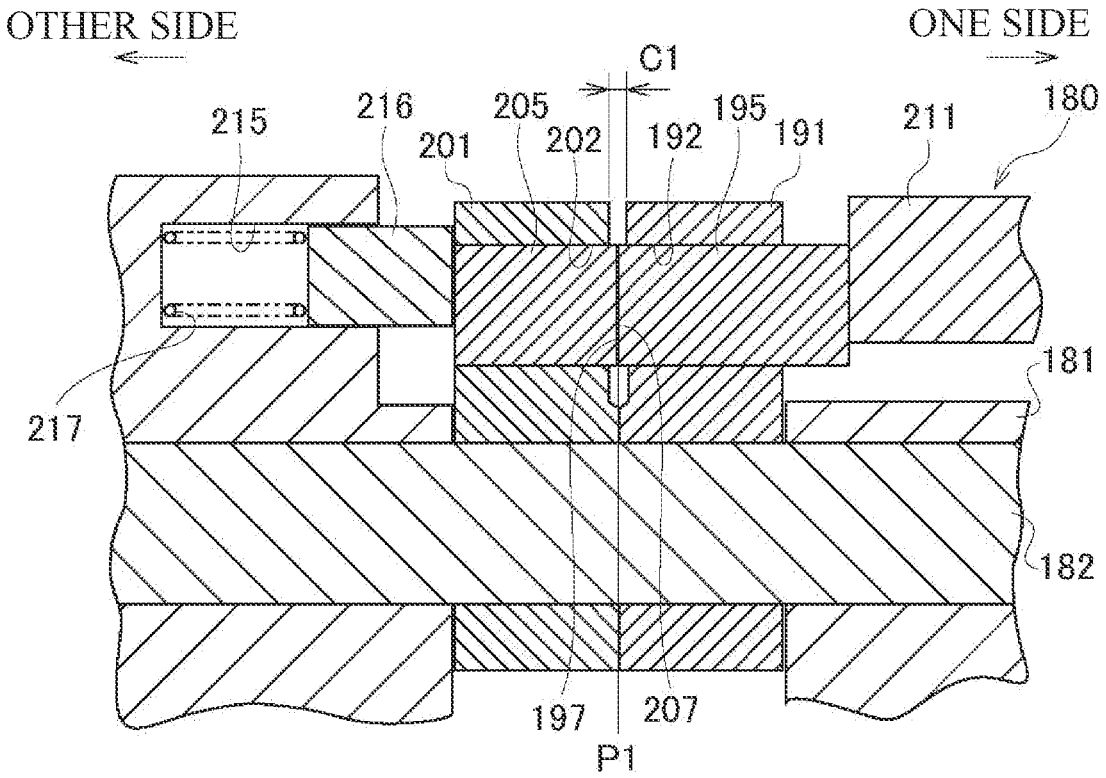
FIGS. 7A and 7B are schematic views of a coupling structure of a pair of rocker arms according to a fifth embodiment.
Figure 7B:
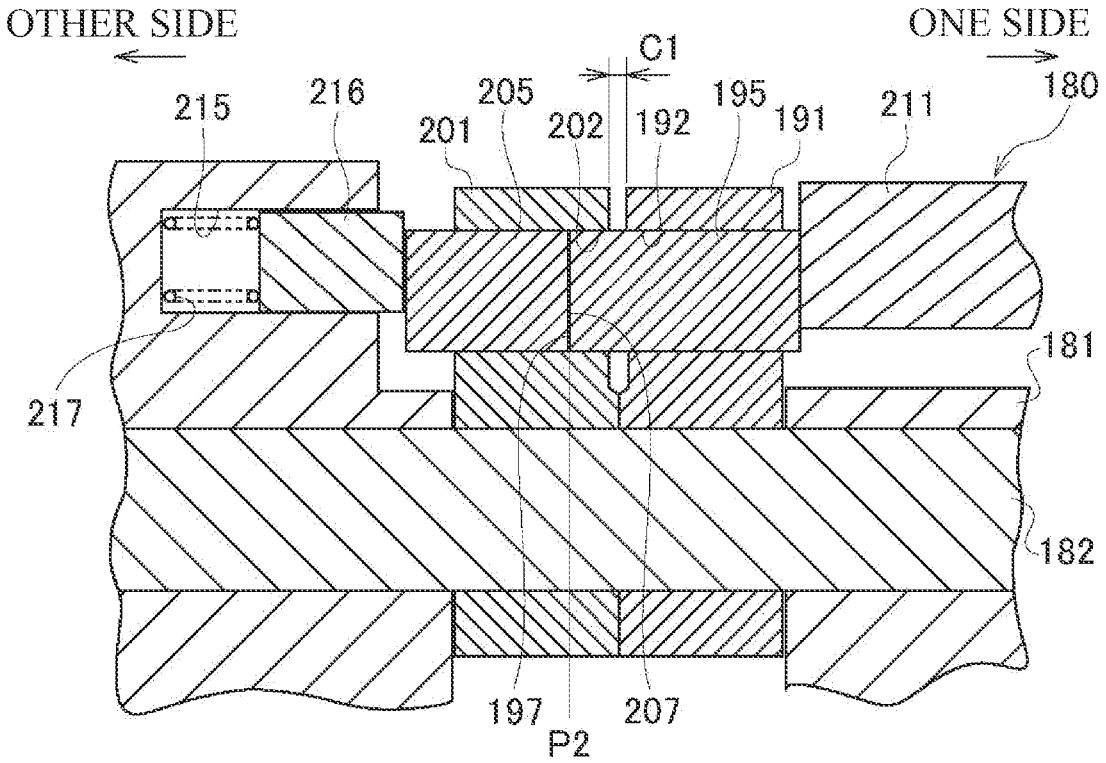

Next, a variable valve apparatus according to a fifth embodiment will be described with reference to FIGS. 7A and 7B. The variable valve apparatus of the fifth embodiment is different from the variable valve apparatus of the first embodiment in that a coupling pin and a release pin are straight pins. Therefore, in the fifth embodiment, description of the same configuration as that of the first embodiment will be omitted. FIGS. 7A and 7B are schematic views of a coupling structure of a pair of rocker arms according to a fifth embodiment. FIG. 7A shows a released state of the pair of rocker arms. FIG. 7B shows a coupled state of the pair of rocker arms.

As shown in FIG. 7A, a rocker shaft 182 extends from one side to the other side inside a cylinder head 181, and a pair of rocker arms 191 and 201 are swingably supported by the rocker shaft 182. A coupling pin 195 is disposed in a housing hole 192 of the rocker arm 191, and a release pin 205 is disposed in a housing hole 202 of the rocker arm 201. A pressing member 211 is disposed on one side of the rocker arm 191, and a guide hole 215 is formed in the cylinder head 181 on the other side of the rocker arm 201. A transmission member 216 and a repulsive spring 217 are arranged in the guide hole 215.

The housing holes 192 and 202 of the pair of rocker arms 191 and 201 are formed straightly, and straight pins are used as the coupling pin 195 and the release pin 205. The coupling pin 195 is formed to be longer than the housing hole 192 of the rocker arm 191, and the release pin 205 is formed to have substantially the same length as the housing hole 202 of the rocker arm 201. In this case, the transmission member 216 abuts against the rocker arm 201, and the coupling pin 195 and the release pin 205 are sandwiched between the transmission member 216 and the pressing member 211, so that the coupling pin 195 and the release pin 205 are positioned at initial positions.

In the released state of the pair of rocker arms 191 and 201, a pressing force is not applied from the pressing member 211 to the coupling pin 195, and a spring force of the repulsive spring 217 is applied to the release pin 205 via the transmission member 216. The transmission member 216 abuts against the rocker arm 201, and the release pin 205 is completely housed in the housing hole 202 of the rocker arm 201. At this time, the other end 197 of the coupling pin 195 is in contact with one end 207 of the release pin 205 at the non-coupling position P1 of the gap C1 between the pair of rocker arms 191 and 201. The other end 197 of the coupling pin 195 is positioned outside the rocker arm 201, and the pair of rocker arms 191 and 201 are separated from each other.

As shown in FIG. 7B, when the coupling pin 195 is pushed in by the pressing member 211, the transmission member 216 is moved to the other side by the coupling pin 195 via the release pin 205. The transmission member 216 is pushed into the guide hole 215 of the cylinder head 181, the repulsive spring 217 is contracted by the transmission member 216, and a repulsive force is accumulated in the repulsive spring 217. The other end 197 of the coupling pin 195 is moved to the other side from the non-coupling position P1 to the coupling position P2 of the rocker arm 201. When a part of the coupling pin 195 enters the housing hole 202 of the rocker arm 201, the pair of rocker arms 191 and 201 are coupled to each other via the coupling pin 195.

As shown in FIG. 7A, when the pushing in of the coupling pin 195 by the pressing member 211 is released, the transmission member 216 is pushed back by the repulsive force of the repulsive spring 217. The release pin 205 is pushed in by the transmission member 216, and the coupling pin 195 is pushed back to one side by the release pin 205. The other end 197 of the coupling pin 195 is moved to the one side from the coupling position P2 to the non-coupling position P1, the transmission member 216 abuts against the rocker arm 201, and the release pin 205 and the coupling pin 195 are respectively returned to the original positions. When a part of the coupling pin 195 comes out of the housing hole 202 of the rocker arm 201, the coupling between the pair of rocker arms 191 and 201 is released.

As described above, according to the variable valve apparatus 180 of the fifth embodiment, the coupled state and the released state of the pair of rocker arms 191 and 201 are switched by a simpler configuration. As in the first embodiment, a problem such as breakage of the repulsive spring 217 does not occur. Further, pin shapes of the coupling pin 195 and the release pin 205 can be simplified and a cost can be reduced.

In the fifth embodiment, the configuration in which the coupling pin and the release pin are straight pins has been exemplified, but at least one of the coupling pin and the release pin may be a straight pin. For example, a straight pin may be used as the coupling pin and a stepped pin may be used as the release pin, or the stepped pin may be used as the coupling pin and the straight pin may be used as the release pin.

Sixth Embodiment

Figure 8A:
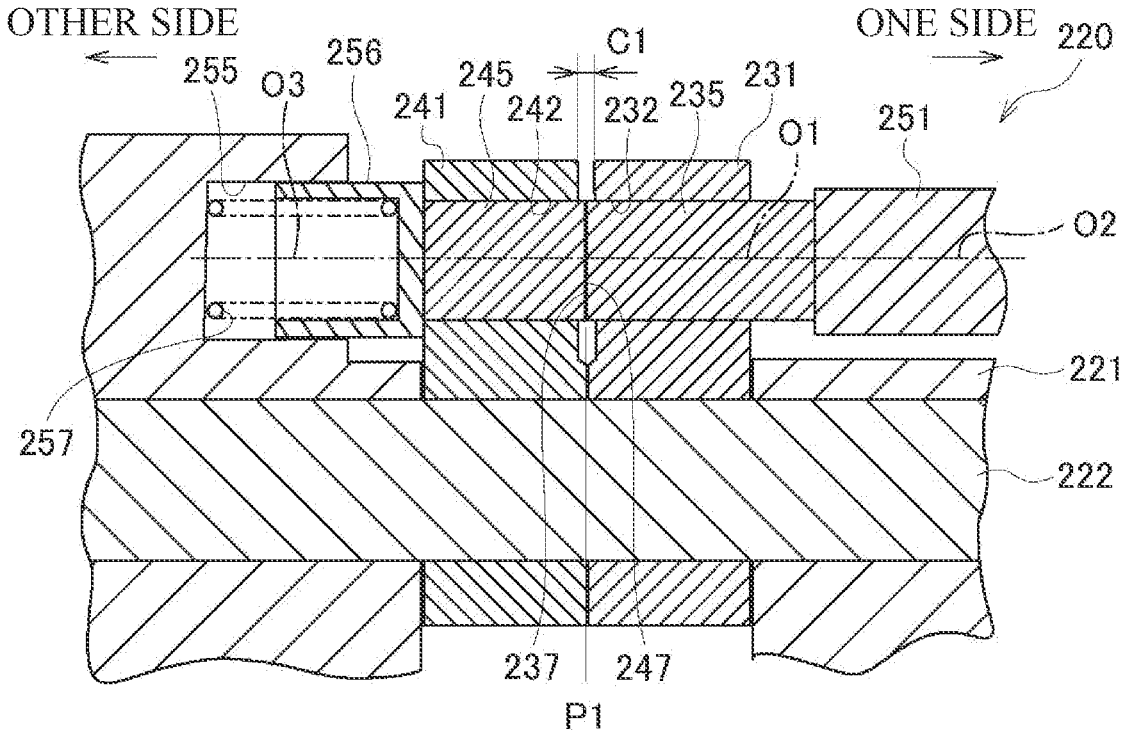
FIGS. 8A and 8B are schematic views of a coupling structure of a pair of rocker arms according to a sixth embodiment.
Figure 8B:
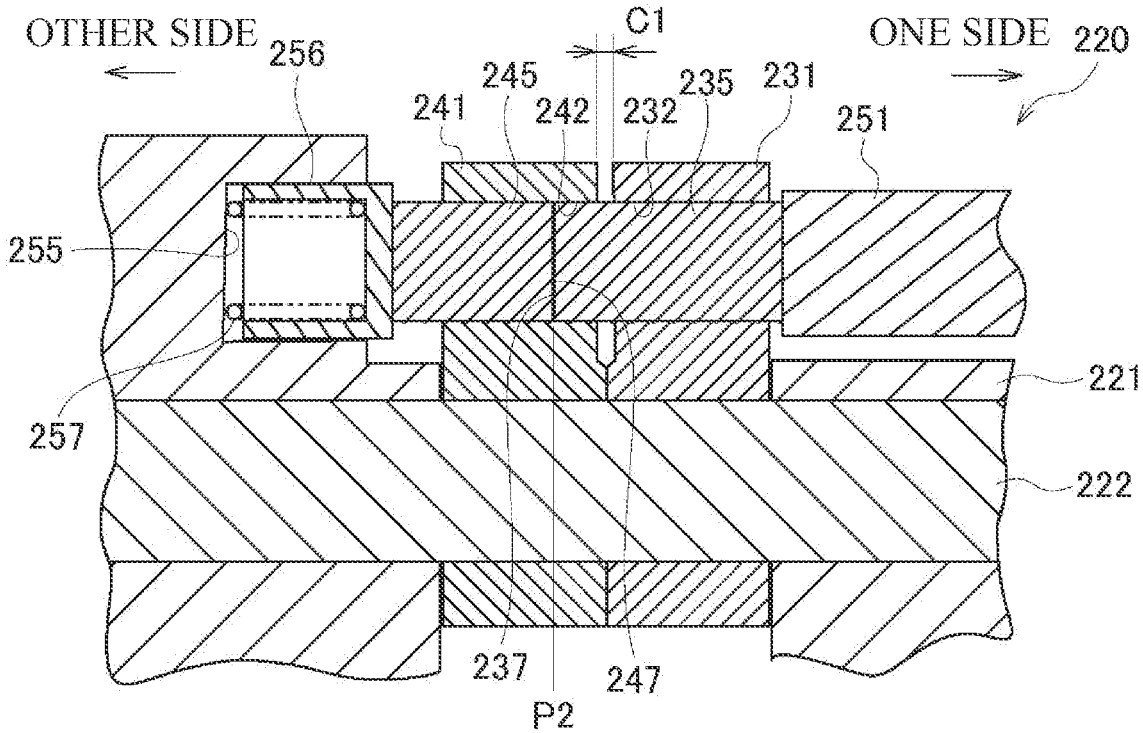

Next, a variable valve apparatus according to a sixth embodiment will be described with reference to FIGS. 8A and 8B. The variable valve apparatus of the sixth embodiment is different from the variable valve apparatus of the first embodiment in that a coupling pin, a release pin, a pressing member, a transmission member, and a repulsive spring are coaxially arranged. Therefore, in the sixth embodiment, description of the same configuration as that of the first embodiment will be omitted. FIGS. 8A and 8B are schematic views of a coupling structure of a pair of rocker arms according to the sixth embodiment. FIG. 8A shows a released state of the pair of rocker arms. FIG. 8B shows a coupled state of the pair of rocker arms.

As shown in FIG. 8A, a rocker shaft 222 extends from one side to the other side inside a cylinder head 221, and a pair of rocker arms 231 and 241 are swingably supported by the rocker shaft 222. A coupling pin 235 is disposed in a housing hole 232 of the rocker arm 231, and a release pin 245 is disposed in a housing hole 242 of the rocker arm 241. A pressing member 251 is disposed on one side of the rocker arm 231, and a guide hole 255 is formed in the cylinder head 221 on the other side of the rocker arm 241. A transmission member 256 and a repulsive spring 257 are arranged in the guide hole 255.

The housing holes 232 and 242 of the pair of rocker arms 231 and 241 are formed straightly, and straight pins are used as the coupling pin 235 and the release pin 245. The coupling pin 235 is formed to be longer than the housing hole 232 of the rocker arm 231, and the release pin 245 is formed to have substantially the same length as the housing hole 242 of the rocker arm 241. In this case, the transmission member 256 abuts against the rocker arm 241, and the coupling pin 235 and the release pin 245 are sandwiched between the transmission member 256 and the pressing member 251, so that the coupling pin 235 and the release pin 245 are positioned at initial positions.

An outer diameter of the pressing member 251 is formed to be larger than an outer diameter of the coupling pin 235, and an outer diameter of the transmission member 256 is formed to be larger than an outer diameter of the release pin 245. In a valve closed state of the pair of intake valves 12 (see FIG. 1), the central axis O2 of the pressing member 251 and the central axis O3 of the transmission member 256 and the central axis O1 of the coupling pin 235 and the release pin 245 are arranged coaxially, so that an axial deviation during movement of the coupling pin 235 and the release pin 245 is suppressed. The transmission member 256 is formed in a bottomed tubular shape, and one end side of the repulsive spring 257 enters an inside of the transmission member 256. Since the repulsive spring 257 enters the inside of the transmission member 256, an installation space of the transmission member 256 and the repulsive spring 257 is reduced.

In a released state of the pair of rocker arms 231 and 241, a pressing force is not applied from the pressing member 251 to the coupling pin 235, and a spring force of the repulsive spring 257 is applied to the release pin 245 via the transmission member 256. The transmission member 256 abuts against the rocker arm 241, and the release pin 245 is completely housed in the housing hole 242 of the rocker arm 241. At this time, the other end 237 of the coupling pin 235 is in contact with one end 247 of the release pin 245 at the non-coupling position P1 of the gap C1 between the pair of rocker arms 231 and 241. The other end 237 of the coupling pin 235 is positioned outside the rocker arm 241, and the pair of rocker arms 231 and 241 are separated from each other.

As shown in FIG. 8B, when the coupling pin 235 is pushed in by the pressing member 251, the transmission member 256 is moved to the other side by the coupling pin 235 via the release pin 245. The transmission member 256 is pushed into the guide hole 255 of the cylinder head 221, the repulsive spring 257 is contracted by the transmission member 256, and a repulsive force is accumulated in the repulsive spring 257. The other end 237 of the coupling pin 235 is moved to the other side from the non-coupling position P1 to the coupling position P2 of the rocker arm 241. When a part of the coupling pin 235 enters the housing hole 242 of the rocker arm 241, the pair of rocker arms 231 and 241 are coupled to each other via the coupling pin 235.

As shown in FIG. 8A, when the pushing in of the coupling pin 235 by the pressing member 251 is released, the transmission member 256 is pushed back by the repulsive force of the repulsive spring 257. The release pin 245 is pushed in by the transmission member 256, and the coupling pin 235 is pushed back to one side by the release pin 245. The other end 237 of the coupling pin 235 is moved to the one side from the coupling position P2 to the non-coupling position P1, the transmission member 256 abuts against the rocker arm 241, and the release pin 245 and the coupling pin 235 are respectively returned to the original positions. When a part of the coupling pin 235 comes out of the housing hole 242 of the rocker arm 241, the coupling between the pair of rocker arms 231 and 241 is released.

As described above, according to the variable valve apparatus 220 of the sixth embodiment, the coupled state and the released state of the pair of rocker arms 231 and 241 are switched by a simpler configuration. As in the first embodiment, a problem such as breakage of the repulsive spring 257 does not occur. Further, pin shapes of the coupling pin 235 and the release pin 245 can be simplified and a cost can be reduced. Furthermore, an axial deviation during movement of the coupling pin 235 and the release pin 245 is suppressed, and locking of the coupling pin 235 and the release pin 245 is suppressed.

In the sixth embodiment, the configuration in which a part of the repulsive spring enters the bottomed tubular-shaped transmission member is exemplified, but as long as the coupling pin, the release pin, the pressing member, the transmission member, and the repulsive spring are coaxially arranged, the shape of the transmission member is not particularly limited. For example, the transmission member may be formed in a straight pin shape.

Seventh Embodiment

Figure 9A:
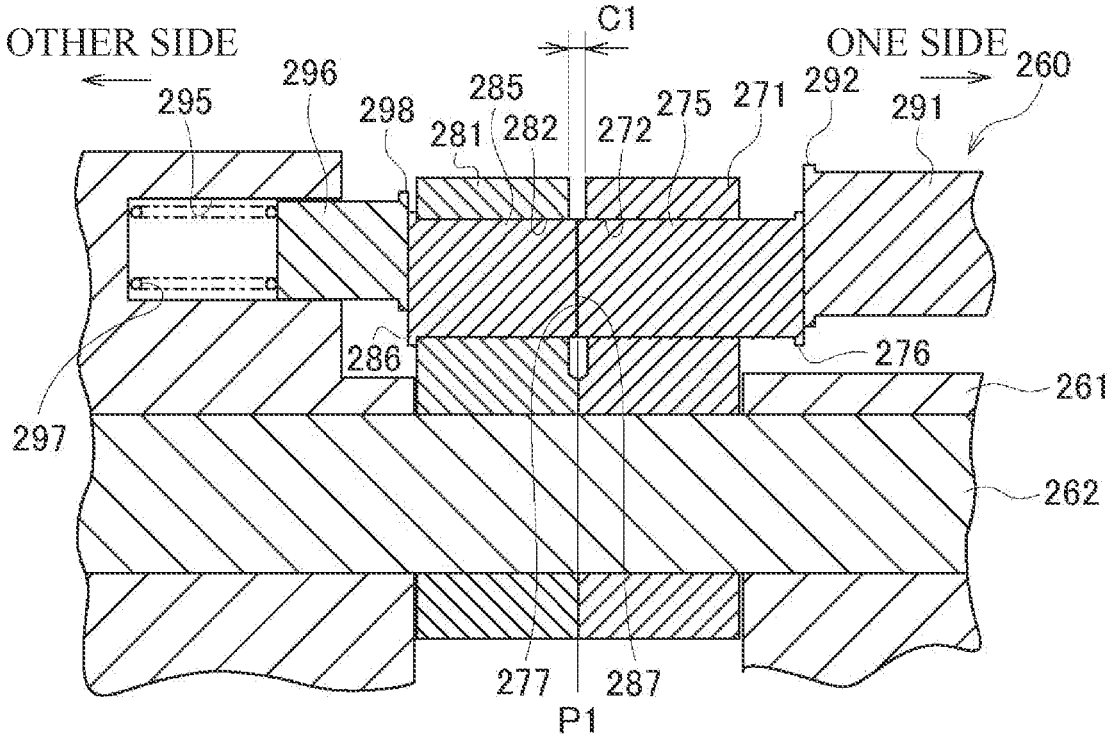
FIGS. 9A and 9B are schematic views of a coupling structure of a pair of rocker arms according to a seventh embodiment.
Figure 9B:
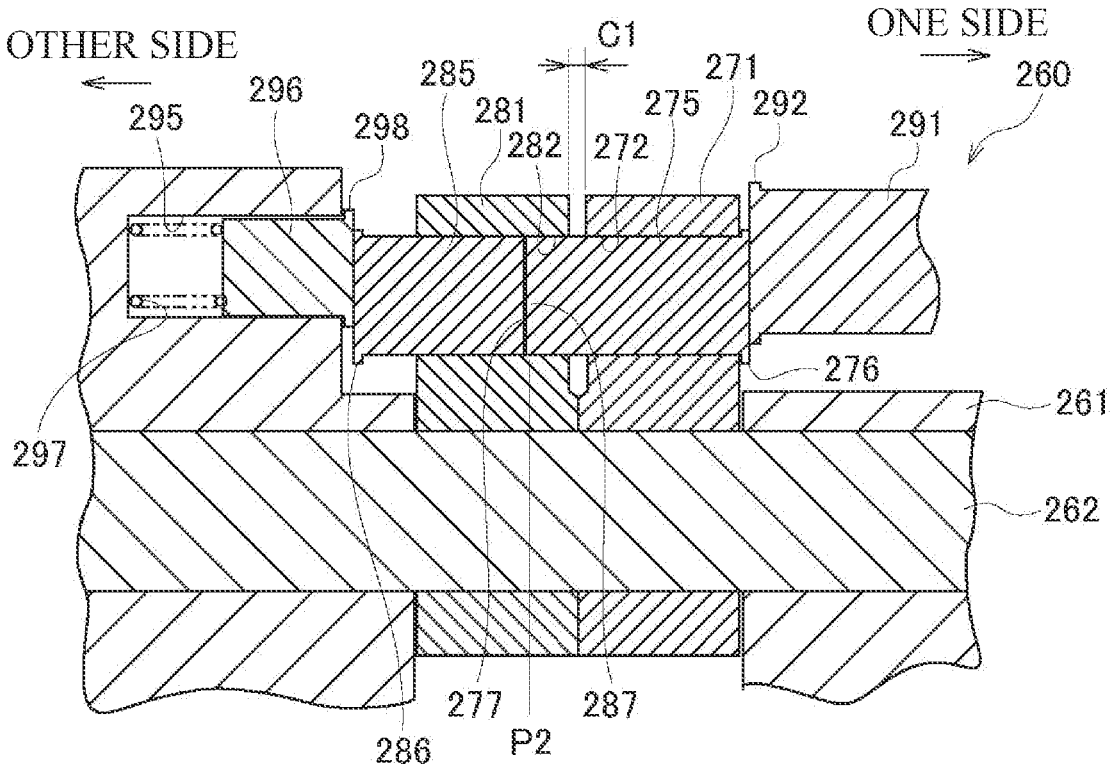

Next, a variable valve apparatus according to a seventh embodiment will be described with reference to FIGS. 9A and 9B. The variable valve apparatus of the seventh embodiment is different from the variable valve apparatus of the first embodiment in that flanges are formed on a coupling pin, a release pin, a pressing member, and a transmission member. Therefore, in the seventh embodiment, description of the same configuration as that of the first embodiment will be omitted. FIGS. 9A and 9B are schematic views of a coupling structure of a pair of rocker arms according to the seventh embodiment. FIG. 9A shows a released state of the pair of rocker arms. FIG. 9B shows a coupled state of the pair of rocker arms.

As shown in FIG. 9A, a rocker shaft 262 extends from one side to the other side inside a cylinder head 261, and a pair of rocker arms 271 and 281 are swingably supported by the rocker shaft 262. A coupling pin 275 is disposed in a housing hole 272 of the rocker arm 271, and a release pin 285 is disposed in a housing hole 282 of the rocker arm 281. A pressing member 291 is disposed on one side of the rocker arm 271, and a guide hole 295 is formed in the cylinder head 261 on the other side of the rocker arm 281. A transmission member 296 and a repulsive spring 297 are arranged in the guide hole 295.

The housing holes 272 and 282 of the pair of rocker arms 271 and 281 are formed straightly, and flange pins are used as the coupling pin 275 and the release pin 285. A flange 276 is formed on one end portion of the coupling pin 275 that protrudes from the rocker arm 271 to one side, and a flange 286 is formed on the other end portion of the release pin 285 that protrudes from the rocker arm 281 to the other side. In this case, when the flange 276 of the coupling pin 275 abuts against the rocker arm 271, pushing in of the coupling pin 275 is restricted, and when the flange 286 of the release pin 285 abuts against the rocker arm 281, pushing back of the release pin 285 is restricted.

The flange pins are also used for the pressing member 291 and the transmission member 296. A flange 292 is formed on the other end portion of the pressing member 291 in contact with the coupling pin 275, and a flange 298 is formed on one end portion of the transmission member 296 in contact with the release pin 285. Since the flanges 276 and 292 are formed on the coupling pin 275 and the pressing member 291, a contact area between the coupling pin 275 and the pressing member 291 is increased. Since the flanges 286 and 298 are formed on the release pin 285 and the transmission member 296, a contact area between the release pin 285 and the transmission member 296 is increased. An axial deviation during movement of the coupling pin 275 and the release pin 285 is suppressed by increasing the contact area.

In the released state of the pair of rocker arms 271 and 281, a pressing force is not applied from the pressing member 291 to the coupling pin 275, and a spring force of the repulsive spring 297 is applied to the release pin 285 via the transmission member 296. The flange 286 of the release pin 285 abuts against the rocker arm 281, and the release pin 285 is positioned at an initial position. At this time, the other end 277 of the coupling pin 275 is in contact with one end 287 of the release pin 285 at the non-coupling position P1 of the gap C1 between the pair of rocker arms 271 and 281. The other end 277 of the coupling pin 275 is positioned outside the rocker arm 281, and the pair of rocker arms 271 and 281 are separated from each other.

As shown in FIG. 9B, when the coupling pin 275 is pushed in by the pressing member 291, the transmission member 296 is moved to the other side by the coupling pin 275 via the release pin 285. The transmission member 296 is pushed into the guide hole 295 of the cylinder head 261, and the repulsive spring 297 is contracted by the transmission member 296. The other end 277 of the coupling pin 275 is moved to the other side from the non-coupling position P1 to the coupling position P2 of the rocker arm 281, and the flange 276 of the coupling pin 275 abuts against the rocker arm 271, and the movement of the coupling pin 275 is restricted. When a part of the coupling pin 275 enters the housing hole 282 of the rocker arm 281, the pair of rocker arms 271 and 281 are coupled to each other via the coupling pin 275.

As shown in FIG. 9A, when the pushing in of the coupling pin 275 by the pressing member 291 is released, the transmission member 296 is pushed back by a repulsive force of the repulsive spring 297. The release pin 285 is pushed in by the transmission member 296, and the coupling pin 275 is pushed back to the one side by the release pin 285. The other end 277 of the coupling pin 275 is moved to the one side from the coupling position P2 to the non-coupling position P1, the flange 286 of the release pin 285 abuts against the rocker arm 281, and the release pin 285 and the coupling pin 275 are respectively returned to the original positions. When a part of the coupling pin 275 comes out of the housing hole 282 of the rocker arm 281, the coupling between the pair of rocker arms 271 and 281 is released.

As described above, according to the variable valve apparatus 260 of the seventh embodiment, the coupled state and the released state of the pair of rocker arms 271 and 281 are switched by a simple configuration. As in the first embodiment, a problem such as breakage of the repulsive spring 297 does not occur. Further, an axial deviation during movement of the coupling pin 275 and the release pin 285 is suppressed, and locking of the coupling pin 275 and the release pin 285 is suppressed.

In the seventh embodiment, the configuration in which the coupling pin, the release pin, the pressing member, and the transmission member are flange pins is exemplified, but at least one of the coupling pin, the release pin, the pressing member, and the transmission member may be a flange pin. For example, a flange pin may be used as the coupling pin, and straight pins may be used as the release pin, the pressing member, and the transmission member.

In the seventh embodiment, a stepped pin may be used as the coupling pin, a flange pin may be used as the release pin, and straight pins may be used as the pressing member and the transmission member.

In the seventh embodiment, stepped pins may be used as the coupling pin and the release pin, a straight pin may be used as the pressing member, and a flange pin may be used as the transmission member.

In the seventh embodiment, a stepped pin may be used as the coupling pin, flange pins may be used as the release pin and the transmission member, and a straight pin may be used as the pressing member.

In the seventh embodiment, straight pins may be used as the coupling pin, the pressing member, and the transmission member, and a flange pin may be used as the release pin.

In the seventh embodiment, straight pins may be used as the coupling pin, the release pin, and the pressing member, and a flange pin may be used as the transmission member.

In the above-described embodiments, the transmission member and the repulsive spring are arranged in the cylinder head, but the transmission member and the repulsive spring may be arranged in a cam housing that supports the camshaft. The transmission member and the repulsive spring may be arranged in a member fixed to the cylinder head and the cam housing.

In the above-described embodiments, the seesaw-type rocker arm is exemplified, but the type of the rocker arm is not particularly limited, and a finger-follower-type rocker arm may be used.

In the above-described embodiments, the pair of rocker arms are provided on the intake side of the variable valve apparatus, but a plurality of rocker arms may be provided on the intake side of the variable valve apparatus. For example, three or more rocker arms may be provided on the intake side of the variable valve apparatus.

In the above-described embodiments, a single rocker arm is provided on the exhaust side of the variable valve apparatus, but a plurality of rocker arms may be provided on the exhaust side of the variable valve apparatus. At this time, the plurality of rocker arms on the exhaust side may also be configured to be switchable between the coupled state and the released state.

In the above-described embodiments, the plurality of rocker arms are adjacent to each other, but the plurality of rocker arms may be separated from each other.

In some embodiments, the configuration in which the central axes of the pressing member and the transmission member and the central axis of the coupling pin and the release pin positionally deviate from each other is exemplified, but the central axes of the pressing member and the transmission member and the central axis of the coupling pin and the release pin may be arranged coaxially.

In some embodiments, the repulsive spring or the hydraulic pressure cylinder is exemplified as the push-back member, but the push-back member may be a member disposed so as to push back the transmission member from the other side. For example, the push-back member may be formed of an elastic member such as rubber.

The variable valve apparatuses of the present embodiments may be applied not only to the engine of the straddle-type vehicle but also to an engine of other vehicle. Further, the straddle-type vehicle is not limited to a motorcycle, and may be any vehicle on which an engine is mounted. The straddle-type vehicle is not limited to general vehicles on which a driver rides in a posture of straddling a seat, and also includes a scooter-type vehicle on which the driver rides without straddling the seat.

As described above, the variable valve apparatus (20) is a variable valve apparatus configured to change a valve operation in a cylinder head (10), the variable valve apparatus (20) including: a rocker shaft (27) configured to extend from one side to the other side inside the cylinder head; a plurality of rocker arms (31, 41) configured to swing around an axis of the rocker shaft; a coupling pin (36) disposed in a housing hole (33) of the rocker arm closer to one side in an axial direction; a release pin (46) disposed in a housing hole (43) of the rocker arm closer to the other side in the axial direction; a pressing member (55) disposed on one side of the rocker arm closer to the one side; a transmission member (58) disposed on the other side of the rocker arm closer to the other side; and a push-back member (the repulsive spring 59) disposed so as to push back the transmission member from the other side. The pressing member is configured to push the coupling pin into the housing hole of the rocker arm closer to the other side while pushing the release pin out toward the other side to couple the plurality of rocker arms. The transmission member is configured to be pushed back by the push-back member and to push back the coupling pin into the housing hole of the rocker arm closer to the one side via the release pin to release a coupling of the plurality of rocker arms. According to this configuration, when the coupling pin is pushed in toward the other side, the coupling pin partially enters the housing hole of the rocker arm closer to the other side from the housing hole of the rocker arm closer to the one side, and the plurality of rocker arms are coupled via the coupling pin. When the pushing in of the coupling pin is released, the coupling pin is pushed back to the one side by the push-back member via the transmission member and the release pin, and the coupling of the plurality of rocker arms is released. In this way, even when the repulsive spring is not disposed in the rocker arm, the coupled state and the released state of the plurality of rocker arms can be switched by a simple configuration.

In the variable valve apparatus, the push-back member is a repulsive spring disposed so as to be in contact with the transmission member from the other side, the pressing member is configured to push the coupling pin into the housing hole of the rocker arm closer to the other side while pushing the release pin out toward the other side against a repulsive force of the repulsive spring to couple the plurality of rocker arms, and the transmission member is configured to be pushed back by the repulsive force of the repulsive spring, and to push back the coupling pin into the housing hole of the rocker arm closer to the one side via the release pin to release the coupling of the plurality of rocker arms. According to this configuration, when the coupling pin is pushed in toward the other side, the coupling pin partially enters the housing hole of the rocker arm closer to the other side from the housing hole of the rocker arm closer to the one side, and the plurality of rocker arms are coupled via the coupling pin. When the pushing in of the coupling pin is released, the coupling pin is pushed back to the one side via the transmission member and the release pin by the repulsive force of the repulsive spring, and the coupling of the plurality of rocker arms is released. Further, the repulsive spring does not swing together with the rocker arms, and the breakage of the repulsive spring, the wear of the peripheral members of the repulsive spring, or the like due to the resonance during the engine operation can be suppressed.

In the variable valve apparatus, the transmission member and the push-back member are arranged in a cam housing configured to support the cylinder head or a camshaft. According to this configuration, there is no need to newly add a component for disposing the repulsive spring, and it is possible to suppress an increase in the size of the variable valve apparatus.

In the variable valve apparatus, a central axis (O1) of the coupling pin and the release pin is closer to the rocker shaft than a central axis (O2) of the pressing member and a central axis (O3) of the transmission member. According to this configuration, since the central axis of the coupling pin and the release pin is close to the rocker shaft, the plurality of rocker arms can be reduced in sizes.

In the variable valve apparatus, in a released state of the plurality of rocker arms, the coupling pin and the pressing member are separated from each other. According to this configuration, the pressing member quickly couples the plurality of rocker arms by the impact of the coupling pin, so that it is possible to cope with the high rotation speed of the engine.

The variable valve apparatus further includes a sensor (138) disposed on the other side of the push-back member, and the sensor is configured to detect a coupled state and a released state of the plurality of rocker arms. According to this configuration, it is possible to detect a malfunction of the variable valve apparatus, such as locking of the coupling pin. Further, since the sensor is disposed on the other side of the push-back member, the variable valve component can be made compact.

In the variable valve apparatus, a rod (139) configured to extend toward the sensor is formed on the transmission member, and the sensor is configured to detect the coupled state and the released state of the plurality of rocker arms based on movement of the rod. According to this configuration, by extending the rod from the transmission member, it is possible to improve a degree of freedom in arrangement of the sensor on the other side of the push-back member.

In the variable valve apparatus, the push-back member is a coil-shaped repulsive spring, and the rod extends to the other side through an inside of the coil-shaped repulsive spring. According to this configuration, the repulsive spring and the transmission member are compactly arranged, and the increase in the size of the variable valve apparatus can be suppressed.

Other variable valve apparatus is a variable valve apparatus (60) configured to change a valve operation in a cylinder head, the variable valve apparatus including: a rocker shaft (62) configured to extend from one side to the other side inside the cylinder head; a plurality of rocker arms (71, 81) configured to swing around an axis of the rocker shaft; a coupling pin (75) disposed in a housing hole (72) of the rocker arm closer to one side in an axial direction; a release pin (85) disposed in a housing hole (82) of the rocker arm closer to the other side in the axial direction; a transmission member (96) disposed on the other side of the rocker arm closer to the other side; and a push-back member (98) disposed so as to push back the transmission member from the other side. A hydraulic pressure cylinder configured to push the coupling pin in toward the other side is formed in the rocker arm closer to the one side. The hydraulic pressure cylinder is configured to push the coupling pin into the housing hole of the rocker arm closer to the other side while pushing the release pin out toward the other side to couple the plurality of rocker arms. The transmission member is configured to be pushed back by the push-back member and to push back the coupling pin into the housing hole of the rocker arm closer to the one side via the release pin to release a coupling of the plurality of rocker arms. According to this configuration, when the coupling pin is pushed in toward the other side by the hydraulic pressure cylinder, the coupling pin partially enters the housing hole of the rocker arm closer to the other side from the housing hole of the rocker arm closer to the one side, and the plurality of rocker arms are coupled via the coupling pin. When the pushing in of the coupling pin is released, the coupling pin is pushed back to the one side by the push-back member via the transmission member and the release pin, and the coupling of the plurality of rocker arms is released. In this way, even when the repulsive spring is not disposed in the rocker arm, the coupled state and the released state of the plurality of rocker arms can be switched by a simple configuration.

Although the present embodiments have been described, the above-described embodiments and modifications may be combined entirely or partially as other embodiment.

The technique of the present invention is not limited to the embodiments described above, and various changes, substitutions, and modifications may be made without departing from the spirit of the technical idea of the present invention. Further, the present invention may be implemented using other methods as long as the technical idea can be implemented by the methods through advance of the technology or other derivative technology. Therefore, the claims cover all embodiments that may be included within the scope of the technical idea.

What is claimed is:

1. A variable valve apparatus configured to change a valve operation in a cylinder head, the variable valve apparatus comprising:

a rocker shaft configured to extend from one side of the cylinder head to the other side of the cylinder head inside the cylinder head;

a plurality of rocker arms configured to swing around an axis of the rocker shaft;

a coupling pin disposed in a housing hole of the rocker arm closer to one side of the cylinder head in an axial direction;

a release pin disposed in a housing hole of the rocker arm closer to the other side of the cylinder head in the axial direction;

a pressing member disposed on the one side of the cylinder head with respect to the rocker arm closer to the one side of the cylinder head;

a transmission member disposed on the other side of the cylinder head with respect to the rocker arm closer to the other side of the cylinder head; and a push-back member disposed on the other side of the cylinder head with respect to the rocker arm closer to the other side of the cylinder head so as to push back the transmission member from the other side of the cylinder head, wherein the pressing member is configured to push the coupling pin into the housing hole of the rocker arm closer to the other side of the cylinder head while pushing the release pin out toward the other side of the cylinder head to couple the plurality of rocker arms, and wherein the transmission member is configured to be pushed back by the push-back member and to push back the coupling pin into the housing hole of the rocker arm closer to the one side of the cylinder head via the release pin to release a coupling of the plurality of rocker arms.

2. The variable valve apparatus according to claim 1, wherein the push-back member is a repulsive spring disposed so as to be in contact with the transmission member from the other side, wherein the pressing member is configured to push the coupling pin into the housing hole of the rocker arm closer to the other side while pushing the release pin out toward the other side against a repulsive force of the repulsive spring to couple the plurality of rocker arms, and wherein the transmission member is configured to be pushed back by the repulsive force of the repulsive spring, and to push back the coupling pin into the housing hole of the rocker arm closer to the one side via the release pin to release the coupling of the plurality of rocker arms.

3. The variable valve apparatus according to claim 1, wherein the transmission member and the push-back member are arranged in a cam housing configured to support the cylinder head or a camshaft.

4. The variable valve apparatus according to claim 1, wherein a central axis of the coupling pin and the release pin is closer to the rocker shaft than a central axis of the pressing member and a central axis of the transmission member.

5. The variable valve apparatus according to claim 1, wherein in a released state of the plurality of rocker arms, the coupling pin and the pressing member are separated from each other.

6. The variable valve apparatus according to claim 1, further comprising:

a sensor disposed on the other side of the cylinder hear with respect to the push-back member, wherein the sensor is configured to detect a coupled state and a released state of the plurality of rocker arms.

7. The variable valve apparatus according to claim 6, wherein a rod configured to extend toward the sensor is formed on the transmission member, and wherein the sensor is configured to detect the coupled state and the released state of the plurality of rocker arms based on movement of the rod.

8. The variable valve apparatus according to claim 7, wherein the push-back member is a coil-shaped repulsive spring, and wherein the rod extends to the other side of the cylinder head through an inside of the coil-shaped repulsive spring.

9. A variable valve apparatus configured to change a valve operation in a cylinder head, the variable valve apparatus comprising:

a rocker shaft configured to extend from one side of the cylinder head to the other side of the cylinder head inside the cylinder head;

a plurality of rocker arms configured to swing around an axis of the rocker shaft;

a coupling pin disposed in a housing hole of the rocker arm closer to one side of the cylinder head in an axial direction;

a release pin disposed in a housing hole of the rocker arm closer to the other side of the cylinder head in the axial direction;

a pressing member disposed on the one side of the cylinder head with respect to the rocker arm closer to the one side of the cylinder head;

a transmission member disposed on the other side of the cylinder head with respect to the rocker arm closer to the other side of the cylinder head;

a push-back member disposed so as to push back the transmission member from the other side of the cylinder head; and a sensor disposed on the other side of the cylinder hear with respect to the push-back member, wherein the pressing member is configured to push the coupling pin into the housing hole of the rocker arm closer to the other side of the cylinder head while pushing the release pin out toward the other side of the cylinder head to couple the plurality of rocker arms, wherein the transmission member is configured to be pushed back by the push-back member and to push back the coupling pin into the housing hole of the rocker arm closer to the one side of the cylinder head via the release pin to release a coupling of the plurality of rocker arms, wherein the sensor is configured to detect a coupled state and a released state of the plurality of rocker arms, wherein a rod configured to extend toward the sensor is formed on the transmission member, and wherein the sensor is configured to detect the coupled state and the released state of the plurality of rocker arms based on movement of the rod.

* * * * *